US006347877B1

(12) United States Patent
Douglass, II

(10) Patent No.: US 6,347,877 B1
(45) Date of Patent: Feb. 19, 2002

(54) CABLE GRID SPECTRAL LIGHTING SYSTEM

(76) Inventor: Myrl Rae Douglass, II, 2726 E. Blanton Dr., Tucson, AZ (US) 85716

( * ) Notice: Subject to any disclaimer, the term of this patent is extended or adjusted under 35 U.S.C. 154(b) by 0 days.

(21) Appl. No.: 09/131,964

(22) Filed: Aug. 10, 1998

Related U.S. Application Data

(60) Provisional application No. 60/055,473, filed on Aug. 12, 1997, and provisional application No. 60/062,715, filed on Oct. 22, 1997.

(51) Int. Cl.[7] ..... F21S 8/00

(52) U.S. Cl. ..... 362/147; 362/293; 362/300-304; 362/282; 362/811; 362/86; 362/87; 362/277; 362/319; 359/367; 359/572

(58) Field of Search ..... 362/811, 86, 87, 362/226, 391, 299, 300, 301, 302, 304, 294, 282, 322, 277, 319, 147; 359/367, 572

(56) References Cited

U.S. PATENT DOCUMENTS

| | | | | | |
|---|---|---|---|---|---|
| 3,388,246 | A | * | 6/1968 | Bailey | 362/285 |
| 4,109,305 | A | | 8/1978 | Claussen et al. | 362/418 |
| 4,256,405 | A | * | 3/1981 | Fjarlie | 356/346 |
| 4,307,528 | A | * | 12/1981 | Deweese et al. | 40/433 |
| 4,716,506 | A | | 12/1987 | Shang | |
| 4,799,764 | A | | 1/1989 | Crowell | |
| 4,837,667 | A | | 6/1989 | Grau | 362/147 |
| 4,843,529 | A | | 6/1989 | Izenour | 362/284 |
| 4,882,661 | A | | 11/1989 | Arnaud | 362/242 |
| 5,077,645 | A | * | 12/1991 | Habinak | 362/226 |
| 5,089,946 | A | | 2/1992 | Mayer et al. | 362/284 |
| 5,247,491 | A | | 9/1993 | Kwiatkowski | |
| 5,347,431 | A | | 9/1994 | Blackwell et al. | 362/11 |
| 5,440,469 | A | | 8/1995 | Gomes | 362/226 |
| 5,455,754 | A | | 10/1995 | Hoffner | 362/250 |
| 5,517,391 | A | | 5/1996 | Grau | 362/147 |
| 5,644,565 | A | * | 7/1997 | Toda et al. | 369/275.1 |
| 5,672,003 | A | | 9/1997 | Shemitz et al. | 362/396 |
| 6,011,650 | A | | 1/2000 | Parker et al. | |

* cited by examiner

*Primary Examiner*—Stephen Husar
*Assistant Examiner*—Ali Alavi
(74) *Attorney, Agent, or Firm*—Garvey, Smith, Nehrbass & Doody, L.L.C.

(57) ABSTRACT

An apparatus consisting of a cable grid system for lighting in which a light can be positioned at any location on a ceiling. Optionally, the light fixtures can include a diffraction grating reflector (such as a music CD) to reflect light patterns onto the ceiling from a light source which is preferably a point source. Also, light fixtures with diffraction grating reflectors could be mounted on a wall, table, or on the ceiling without using a cable grid system.

18 Claims, 33 Drawing Sheets

CABLE GRID SPECTRAL LIGHTING SYSTEM

CROSS-REFERENCE TO RELATED APPLICATIONS

U.S. patent application Ser. No. 08/735,069, filed Oct. 18, 1996, now U.S. Pat. No. 5,791,775 and U.S. patent application Ser. No. 08/934,910, filed Sep. 22, 1997, now U.S. Pat. No. 5,997,151 are incorporated herein by reference. Also by reference are U.S. Provisional Patent Application Ser. No. 60/005,742, filed Oct. 20, 1995, U.S. Provisional Patent Application Ser. No. 60/055,473, filed Aug. 12, 1997, and U.S. Provisional Patent Application Ser. No. 60/062,715, filed Oct. 22, 1997. Priority of U.S. Provisional Patent Application Ser. No. 60/055,473, filed Aug. 12, 1997, and U.S. Provisional Patent Application Ser. No. 60/062,715, filed Oct. 22, 1997, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to ceiling hung, low voltage lighting fixtures and to reflectors for lights.

2. General Background of the Invention

Low voltage exposed wire light systems allow flexibility of placement of lights along the length of the wires, but are generally limited to placement along parallel lines on the ceiling.

Colored lighting has been used for centuries to convey moods and create special theatrical effects. Most projected colored light has been created by passing light through either colored gels, dichroic filters, or oil membranes. In either case the resulting color of light has been dependent on the color of the filter, or substance the light passes through.

The following U.S. Patents are incorporated herein by reference:

| U.S. Pat. Nos.: | | |
|---|---|---|
| 5,672,003 | 5,517,391 | 5,455,754 |
| 5,440,469 | 5,089,946 | 4,843,529 |
| 4,837,667 | 4,109,305 | 4,882,661 |
| 5,347,431 | | |

BRIEF SUMMARY OF THE INVENTION

A system of lighting allowing the complete flexibility of placement of ceiling hung, low voltage lighting fixtures within a space in both the X and Y axis. This system consists of a parallel array of electrified support wires spanning the width of the room in one axis, and a series of lighting fixtures consisting of a central body housing the light source with two support arms at opposing sides of the central body that are in line with each other. Each arm of the light fixture is designed to carry opposing poles of low voltage current (12V, e.g.) to the light source. Each support wire is charged with a single pole of current, and the wires are arranged so that every other wire has the same polarity. The arms of each fixture are designed to rest on two support wires arranged roughly perpendicular to the axis of the wires. The length of each support arm equals the distance that the support wires are spaced from each other, so that they can maintain support wherever the fixture is placed perpendicular to the axis of the wires. The fixture may be placed anywhere along either the axis of the support wires or the axis of the support arms. The fixture consists of a recessed downspot aimed through the center of a radial diffraction grating such as a CD or Laser Disk. This arrangement allows the majority of the light beam to be directed downward through the open center of the disk. The outer edge of the beam hits the data storage portion of the disk which acts as a radial diffraction grating and sends a multi-colored pool of diffracted light back towards the ceiling. The data storage portion of the CD acts as a diffraction grating because of the constant size and spacing of the reflective pits on its surface. The radial aspect of the grating acts to focus the radial nature of the light source into coherent rainbow displays of light. This invention is not limited to use with only a CD. Any other radial diffraction grating will produce similar effects with this particular arrangement. CDs, however, are ideally suited for this application, because of their availability and that they are among the smallest and most accurate of all manufactured diffraction gratings, creating spectral displays of high resolution and clarity. This arrangement of spotlight to CD has proven to create some desirable optical effects, but other lighting configurations using this principle are also included herein that do not rely on a symmetrical, radial grating to function. By placing the grating at an acute enough angle to the light source, the white light can be completely separated from the first spectral order of rainbow light. This arrangement allows gratings made out of multiple radial patterns, linear patterns, and even combinations of the two to function in a similar manner.

The system of lighting is similar to other low voltage exposed wire systems in that it allows flexibility along the length of the wires, but novel in that the flexibility exists in two axes. This system was invented to satisfy the need to have a downspot centered over each table in the dining room of a restaurant, allowing the lights to remain centered over each table even if they are positioned into new arrangements within the space. The system allows flexibility while maintaining a clean and uninterrupted ceiling plane.

The system is also novel in that it can also provide multi-colored lighting to the ceiling using a radial diffraction grating such as a CD. Colored light in this invention is created entirely from diffraction. Diffraction gratings of high resolution have traditionally been very costly to manufacture. With the advent of the laser in the last few decades has come a wealth of advances that have made high resolution diffraction gratings both affordable and commonplace in our everyday lives. The CD is a perfect example of this and will enable this invention to be produced at an affordable price point. This invention can be applied to any other space that requires this flexibility such as exhibit halls, open plan offices, banquet facilities and galleries.

The diffraction grating can be applied to any other lighting fixture or apparatus to project colored light on a surface.

BRIEF DESCRIPTION OF THE SEVERAL VIEWS OF THE DRAWINGS

For a further understanding of the nature, objects, and advantages of the present invention, reference should be made to the following detailed description, read in conjunction with the following drawings, wherein like reference numerals denote like elements and wherein.

DETAILED DESCRIPTION OF THE INVENTION

Figure 1:
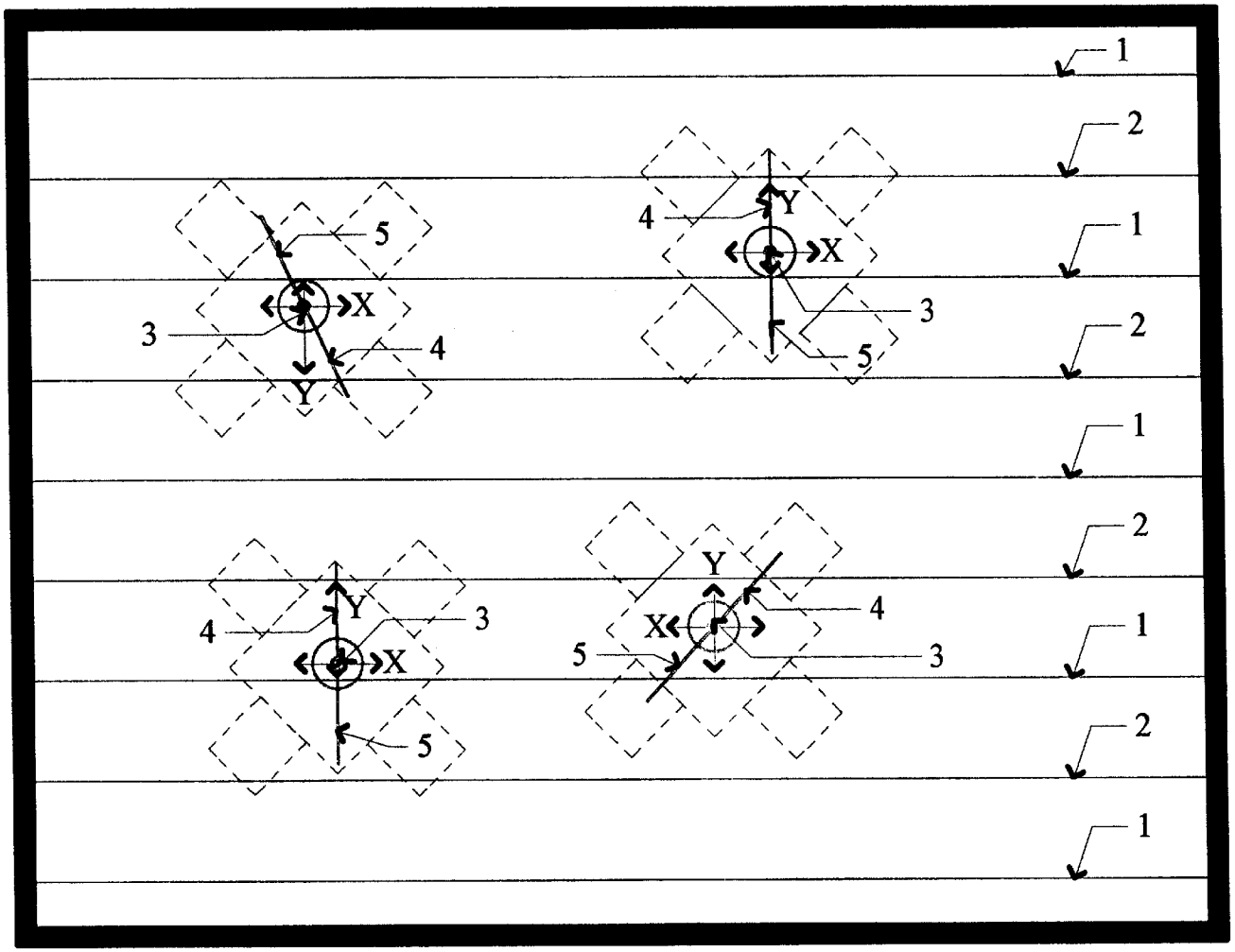
FIG. 1 is a floor plan of a typical space layout showing the basic components of the system of the present invention.
Figure 2:
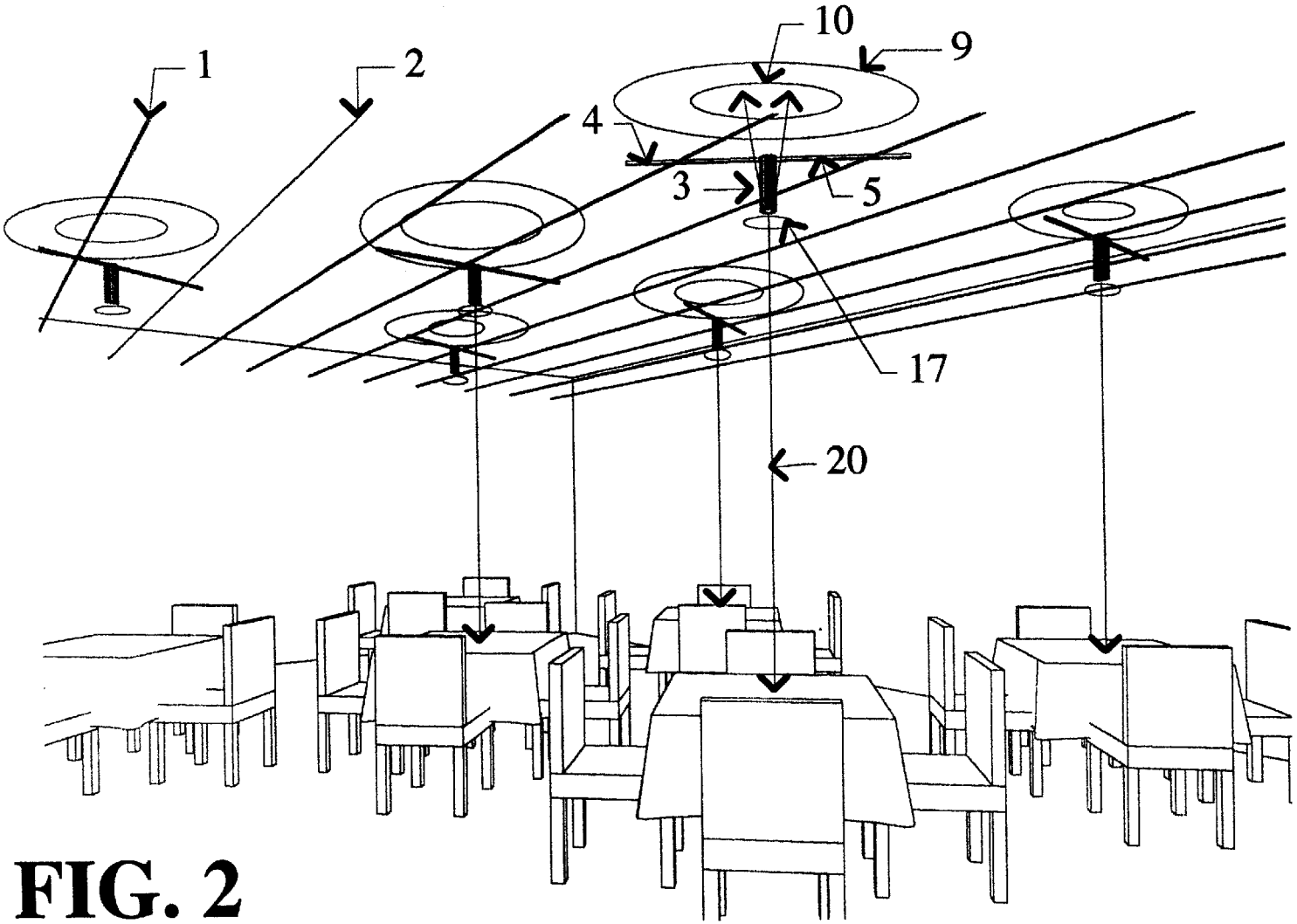
FIG. 2 is a perspective view of a typical space layout showing the basic components of the system of the present invention.

As shown in FIGS. 1 and 2, the basic components of the trapeze grid lighting system are the support cables 1 charged with positive low voltage current, the support cables 2 charged with negative low voltage current, the main body 3 of the lighting fixture housing the light source 6, the support arm 4 conducting negative low voltage current, and the support arm 5 conducting positive low voltage current. The support cables 1, 2 are attached to, and span the distance between, two opposing walls or surfaces 7 in a space. The support cables are preferably all mounted at the same height at a distance below the projected surface (ceiling plane) 8 to allow for proper clearance of the main body of the lighting fixture 3. The support cables preferably are not insulated, and can be made and mounted in the same manner as the cables in other suspension wire lighting systems (such as the Yayaho brand lighting system commercially available from Ingo Maurer GMBH of Germany). The support cables are preferably mounted parallel to each other at a distance that is proportionally correct for the space. The lines 1 and 2 are suspended using a turnbuckle assembly, for example. The support arms 4, 5 of the lighting fixture preferably rest directly on top of two adjacent support cables, each conducting opposing poles of current from each cable. The lighting fixture 3 is preferably balanced so that gravity holds it onto the support cables no matter what distance it is placed from either cable. This balance not only allows it to be placed in any position along the length of the support wires, but in any position in the axis perpendicular to the wires as shown in FIG. 1. The position of the light can preferably be changed so that it can be centered directly over certain objects or places within a space, such as a dining room table. FIG. 2 shows how light is distributed from the fixture. A circular pool of light is created by white light 20, that has passed through the open center of the diffraction grating. This light provides useful direct illumination for the space. The remainder of the light is diffracted by the diffraction grating back towards the ceiling into another circular pool of light 9. This pool of light is different from the first in that most of its center 10 is composed of a colorful array of diffracted light produced by the diffraction grating 17.

Figure 3:
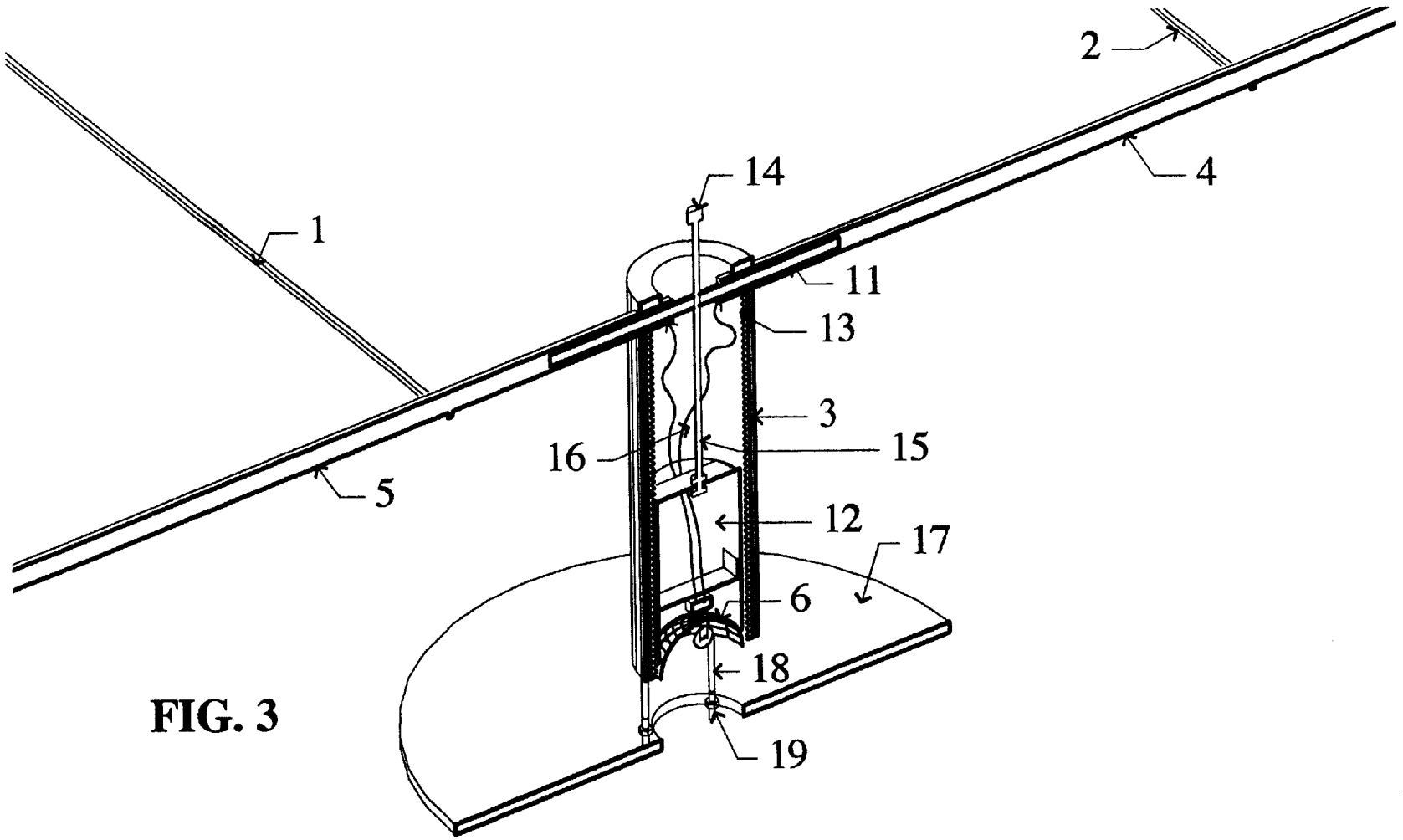
FIG. 3 is a sectional axonometric view of a typical light fixture showing its detailed components of the present invention.

FIG. 3 shows the components of the lighting fixture 3. The support arms 4, 5 are preferably made of a conductive and rigid material such as copper, graphite or aluminum, and are attached directly to the central body 3 of the lighting fixture which is preferably made out of a tubular non-conductive material such as ceramic or plastic. The support arms are preferably attached to each other with a rigid non-conductive rod 11 that holds them in alignment with each other, yet isolates their electrical polarities. Inside of the central body is a chassis 12 (preferably made of aluminum) that holds the light source 6. The chassis may telescope within the central body to both focus the light beam and access the bulb for maintenance, and is preferably held in place with a focusing knob 14 and threaded rod 15. MR11 or MR 16 low voltage spots seem to work the best as the light source 6, though other well focused (so it is relatively easy to adjust the apparatus so that the colored light and white light can separate) light sources could also be used efficiently. The interior of the central body is preferably lined with a ceramic fiber heat shield 13 to protect it from the intense heat generated from the quartz light source. Preferably heat-insulated wires 16 connect the two poles of the light socket to each support arm, with preferably enough play to allow the central chassis to telescope freely. A diffraction grating 17, made out of for example a CD (compact disk) or Laser Disk, is suspended below the base of the central body with a series of small diameter metal rods 18 set into the end of the central body tube. The diffraction grating 17 can be attached to the rods with small nuts 19 that are screwed into the ends of the rods that allow some adjustment to the alignment of the disk to the central body. Rubber grommets inserted into the holes drilled into the CD for the support rods may be used in place of the small nuts to hold the CD in place and provide a faster means of adjustment.

Figure 4:
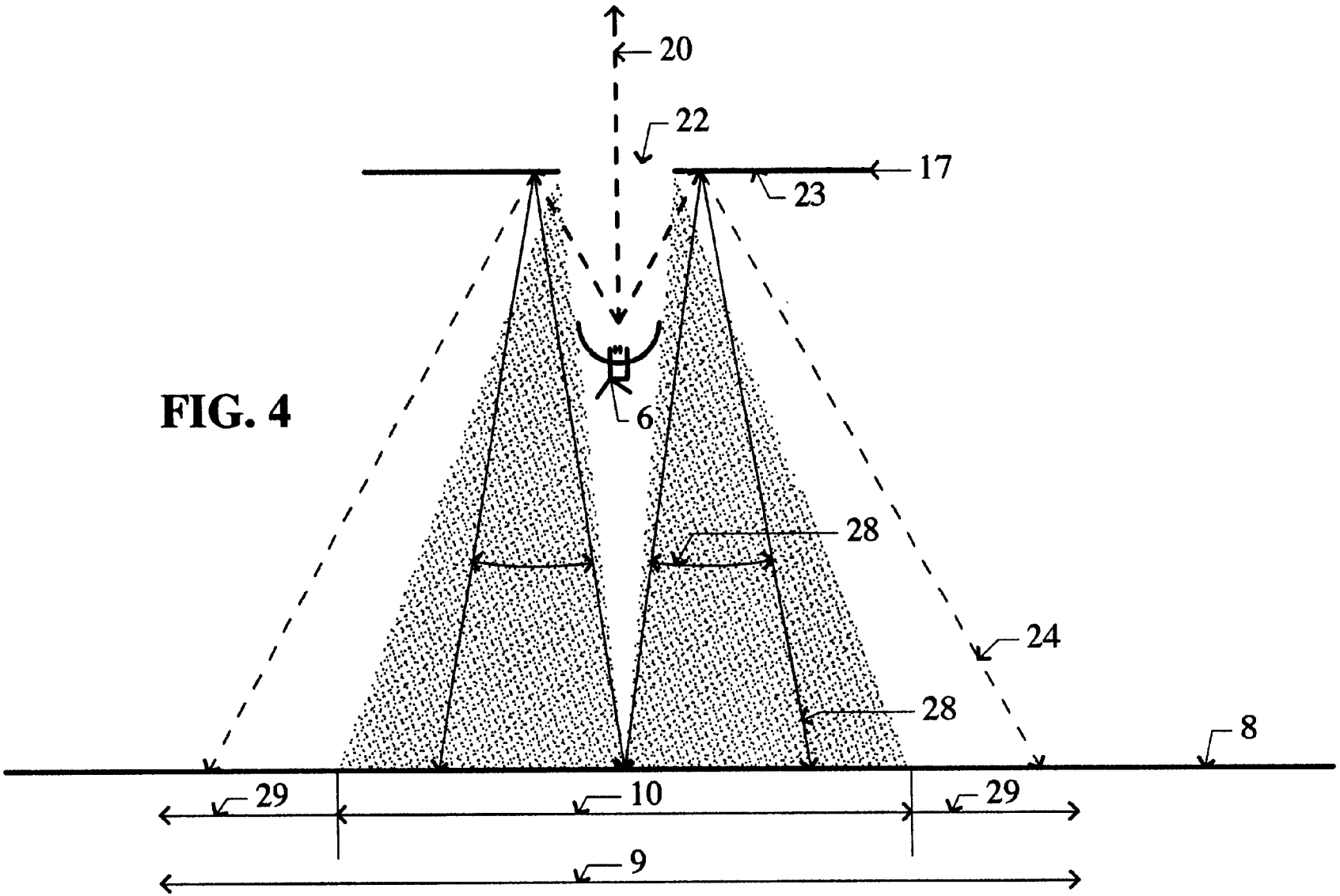
FIG. 4 is a diagrammatic section describing the principles behind the diffraction grating lighting system of the present invention.

FIG. 4 is a diagrammatic section describing the way light projected from the spot light source 6 is reflected and diffracted by the diffraction grating 17 (in this case, a CD). Light rays 20 emitted by the spot light source 6 radiate out in an arc that is determined by the beam spread angle of the reflector of the spot light. Most of the light rays pass through the clear, open center 22 of the CD, but the rays at the outward edge of the beam hit the diffractive portion 23 of the CD. The light rays create a roughly circular pool of light 9 that is visible on the projected surface. In the light diffracted from the grating there is a central order (also called zeroth-order) 24, white fringe, which is perceived as white reflected light because it is composed of light with multiple wavelengths comprised of the full spectrum. Due to the geometry of the optics, the central order 24 is projected at only the outer portion of the pool of light creating a white halo 29. Next to this is the first spectral order which has all of the light rays neatly grouped into common wavelengths 28, and are only visible in the center of the pool 10 where the full spectrum rays of the zeroth order are not projected, and will not absorb them. The visible spectrum consists of a range from violet to red. The center of the pool 10 is also the spot where the first spectral order 28 is most concentrated. In this central portion 10 radial patterns of colored light are created that resemble anything from flowers to supernovas in any color imaginable.

Figure 7:
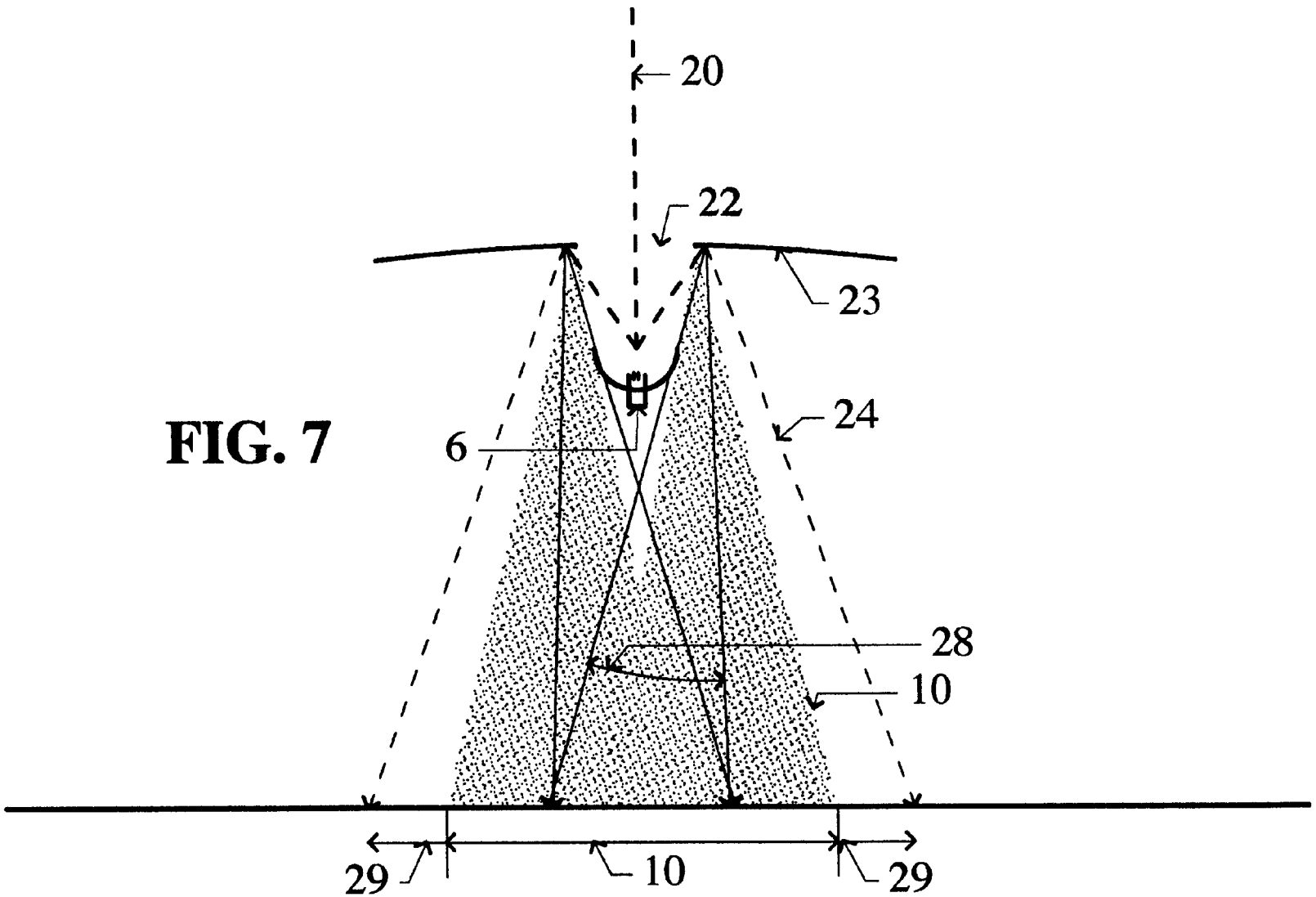
Figure 8:
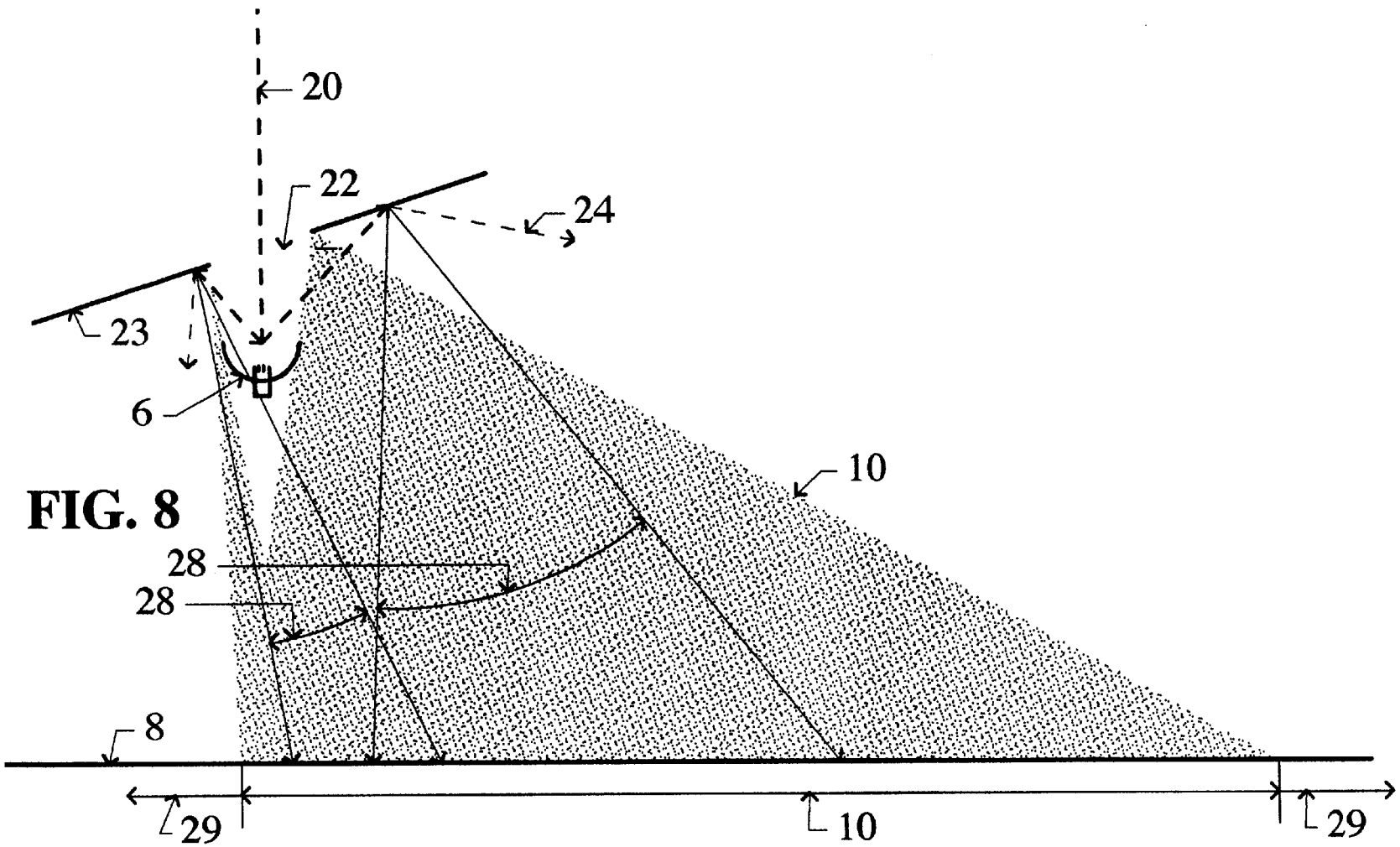
FIG. 8 is a diagrammatic section showing how tilting the diffraction grating to the light source affects the resulting light patterns.

Variety to the light display is created in the following ways: 1. Adjustments to the focal lengths of the optical components determines the general color range and size of the display. (Shorter focal lengths shift towards the red and are smaller, longer towards the violet and are larger). 2. Selection of the light source affects the brightness and pattern of the display. (A higher wattage bulb yields a brighter display, and the facet pattern on the reflector directly affects the pattern of light displayed at certain focal lengths) Bulbs with translucent lenses do not work because they diffuse the light source into too large of an area for the geometry of the optics to fully separate the white light from the rainbow light. 3. Selection of the diffraction grating determines the overall clarity and resolution of the display. 4. Tilting the angle of the diffraction grating to the light source creates asymmetrical displays as shown in FIG. 8. 5. Warping the surface of the diffraction grating causes the display to either collapse or expand as shown in FIGS. 6 and 7.

Figure 5:
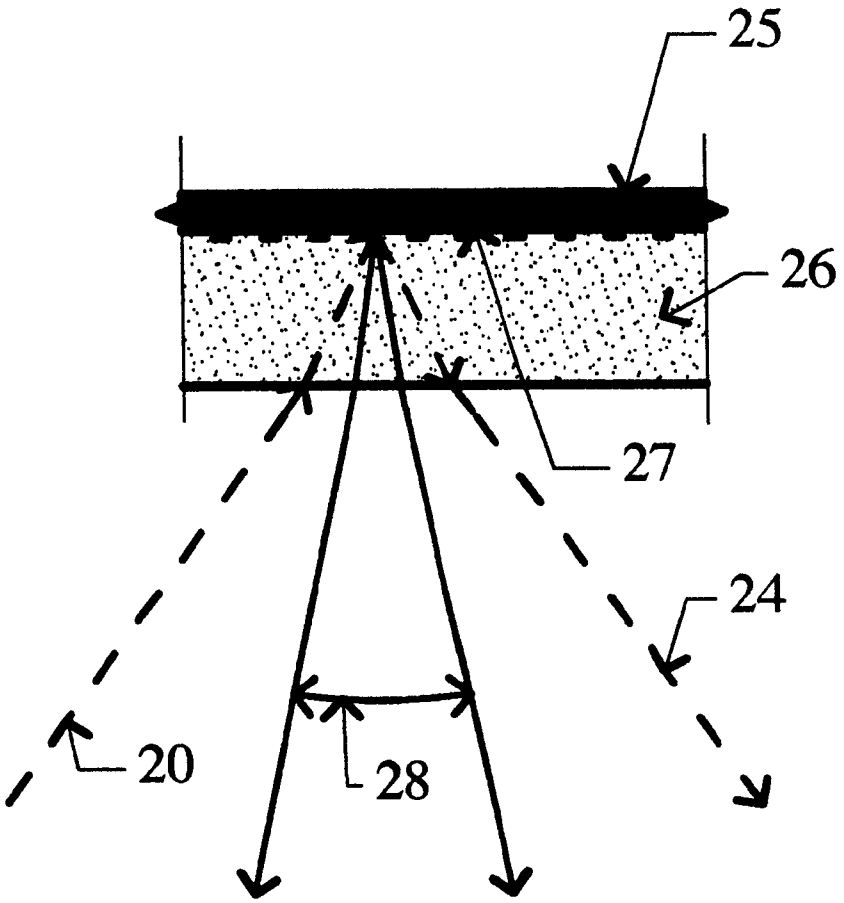
FIG. 5 is a detailed section describing the surface of the diffraction grating.

FIG. 5 shows the diffractive surface of the compact disk, which is made of a microscopically thin layer of aluminum 25 that is sandwiched on top of a layer of clear plastic 26. The surface of the aluminum layer has been etched with thousands of microscopic grooves 27 that radiate from the center of the disk. The grooves in a CD create an almost ideal diffraction grating. The size and spacing of the grooves in a CD is diffraction-limited. CDs, with a groove spacing of 600 per millimeter, have some of the smallest possible grid formations that still function with the wave nature of light, enabling them to create highly resolved spectral displays. The key property of a diffraction grating is that it sends a lot of light (i.e., a large fraction of the incident beam) into well defined directions. These directions depend on the wavelength of the light and the grating constant. The smaller the grating constant, the more well defined the colors will be. CD's are ideal for this purpose because they produce colored light of high definition and clarity with very little overlapping of spectral orders within the field of view of the light pool. Linear diffraction gratings have been manufactured with a groove spacing as tight as 1200 per millimeter that have a blazed profile to the grooves to give them more efficiency in a specific spectral region. So, it is conceivable that if a custom made diffraction grating is fabricated with a blazed groove profile and tighter spacing than a CD, performance could be improved.

The physical characteristics of a typical CD are as follows: Compact disk diameter is 120 millimeters, hole diameter is 15 millimeters, and thickness is 1.2 millimeters. The innermost part of the disk does not hold data; it provides a clamping area for the player to hold the disk firmly to the spindle motor shaft. Data is recorded on an area 35.5 millimeters wide. A lead-in area rings the innermost data area, and a lead-out area rings the outermost area. The lead-in and lead-out areas contain non-audio data used to control the player which can be seen on many disks as a change in appearance in the reflective data surface. A transparent plastic substrate 26 forms most of the disk 1.2 millimeter thickness. Data is physically contained in pits, arranged along a track (groove), which are impressed along its top surface and are covered with a very thin (50 to 100 nanometers) metal (e.g., aluminum, silver, or gold) layer. Another thin (10 to 30 micrometers) plastic layer protects the metallic pit surface, on top of which the identifying label (5 micrometers) is printed. A disk contains a track of pits arranged in a continuous spiral running from the inner circumference to the outer. The angle of the spiral is so slight that the pattern is basically radial in nature. The distance between tracks is only 1.6 micrometers (600 tracks to a millimeter). The pits are 0.5 micrometers in width and depth.

Figure 6:
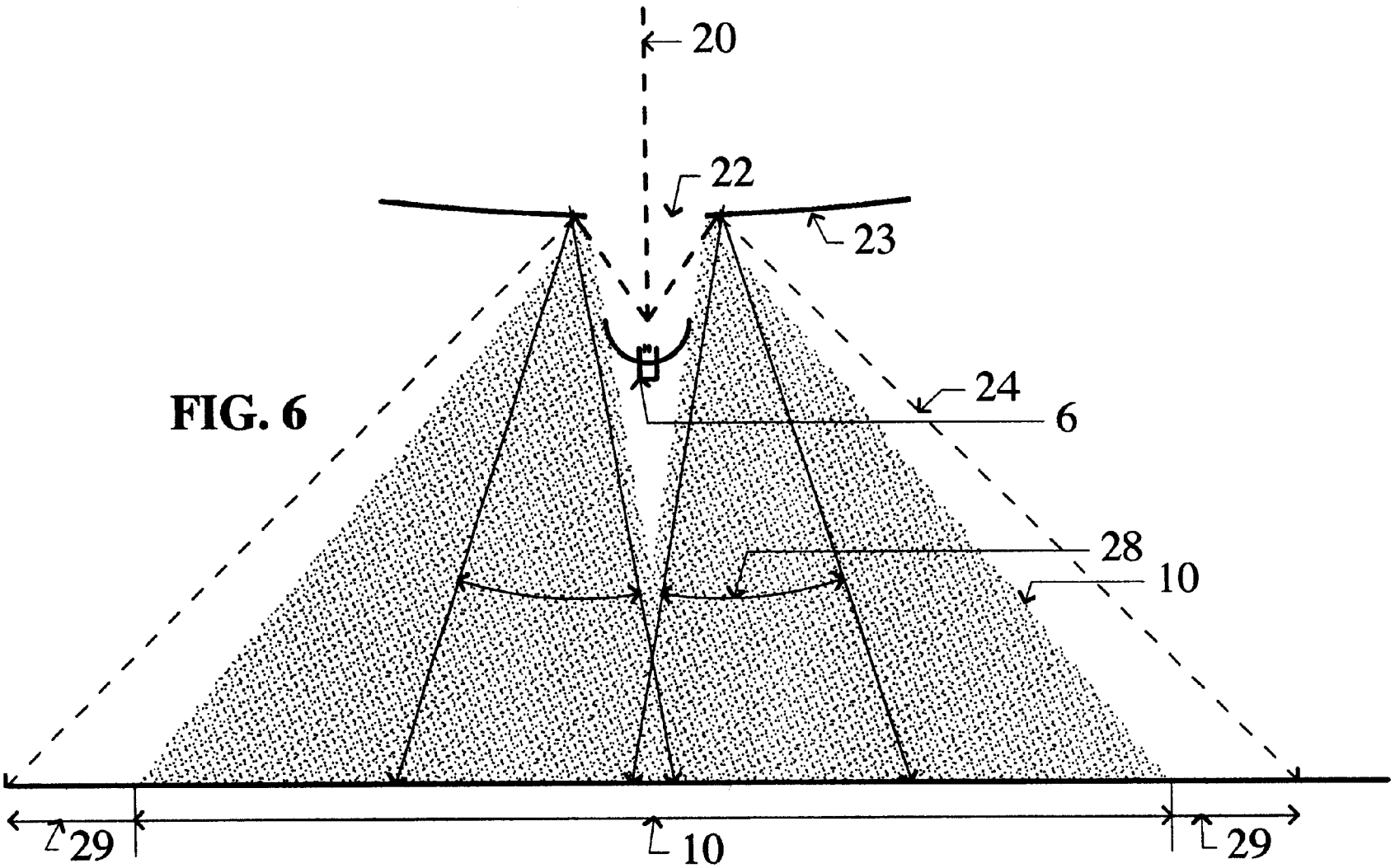
FIGS. 6 and 7 are diagrammatic sections showing how heat created from the light source deflects the diffraction grating and affects the resulting light patterns.

FIG. 6 shows how heat generated from the light source causes the center of the CD to expand creating either a concave or convex surface, and the resulting effects to the projected light. As the center of the CD is heated it slowly expands causing the surface to become convex. As a result, the light pattern appears to slowly expand or unfold like the petals of a flower. This effect occurs in all applications.

The disk may be flexed from a concave to a convex shape as shown in FIG. 7. This can be assisted with a servo mechanism to create undulating light patterns. This effect can be used for either mood or special effects lighting.

FIG. 8 shows the resulting light patterns created by tilting the CD to the light source. The light pattern becomes asymmetrical in shape with the smallest and most defined patterns where the disk is closest to the projected surface. This effect is most useful in wall sconces and light effects generators.

Figure 9:
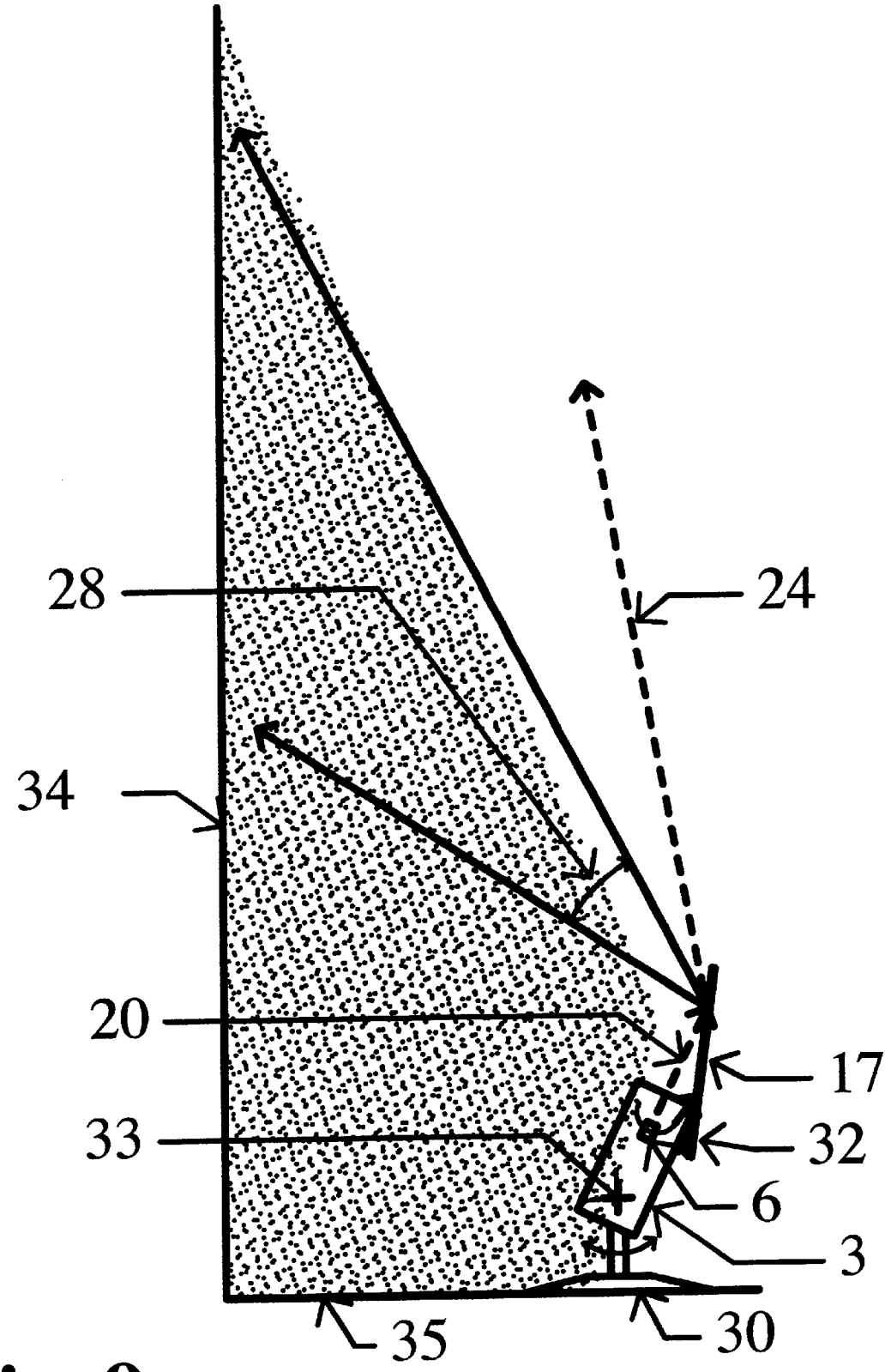
FIG. 9 is a diagrammatic section showing a floor mounted fixture of the present invention using a tilted diffraction grating.

FIG. 9 shows a sectional view of a lighting fixture using a CD or diffraction grating 17 tilted at an acute angle from the light source 6, and mounted to the side of the body of the light fixture 3 with an adjustable bracket 32. This fixture works on the principle that the CD must be at an acute enough angle so that orders of white 24 and rainbow light 28 are projected far enough apart so that the rainbow light is projected in the shadow where the white light is not projected and will not absorb the rainbow display of diffracted light. This design produces a vibrant asymmetrical display of colored light 100 that can be varied by adjusting the angle of the fixture to the surface that the light is projected upon 34, adjusting the angle that the diffraction grating 17 is set in relationship to the light source 6, changing the light source and/or its reflector, and changing the type of diffraction grating 17. A linear diffraction grating oriented so that the lines of the grating are set perpendicular to the direction of the light source produces the most vibrant displays. This is because the beam of light is cast to one side of the fixture in a linear fashion, and a larger percentage of the lines in a linear grating are perpendicular to the light rays as they hit the surface of the grating, than if the lines were arched as in a radial grating such as a CD. A radial grating works better for the previous embodiments because the light is projected and radiates from the center of the radial grating. The concentric spiraling lines of the CD all fall perpendicular to the central radiating light source. The light fixture is preferably attached to a flat base 30 with a swivel assembly 33, which allows the angle that the base is attached to the rest of the fixture to be adjusted so that it may be mounted on either a flat surface, wall, or ceiling. The swivel assembly also enables adjustments to the angle that the light fixture is positioned to the surface that is projected upon, which directly affects both the size an shape of the display of rainbow light 100. FIG. 9 shows the fixture mounted on a flat surface 35 with its light projected on an adjacent wall surface 34.

Figure 10:
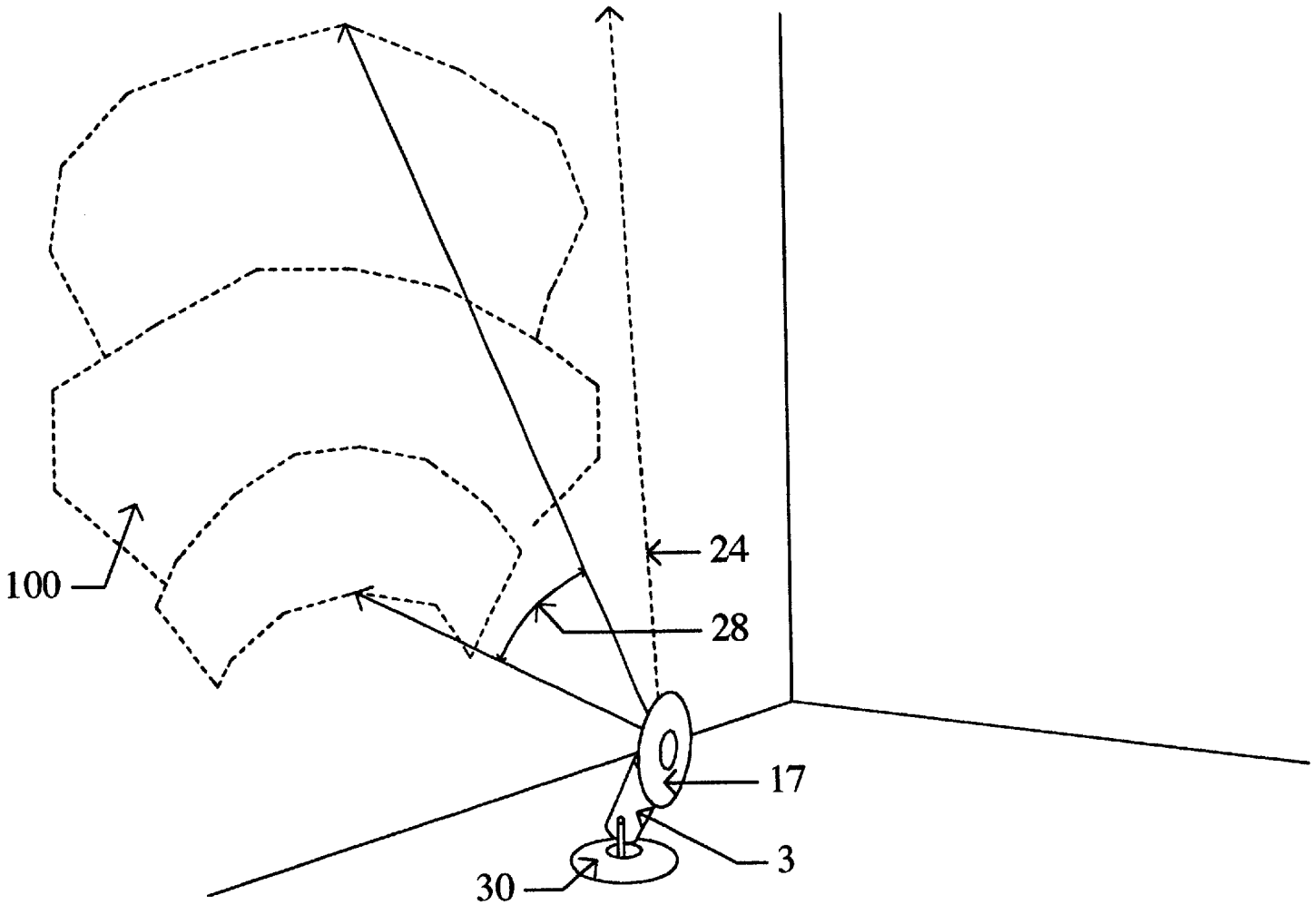
FIG. 10 is a perspective view of the fixture shown in FIG. 9.

FIG. 10 is a perspective view of the same fixture showing the rainbow display 100 on the adjacent wall, and direction that the white incident light 24 is projected.

Figure 11:
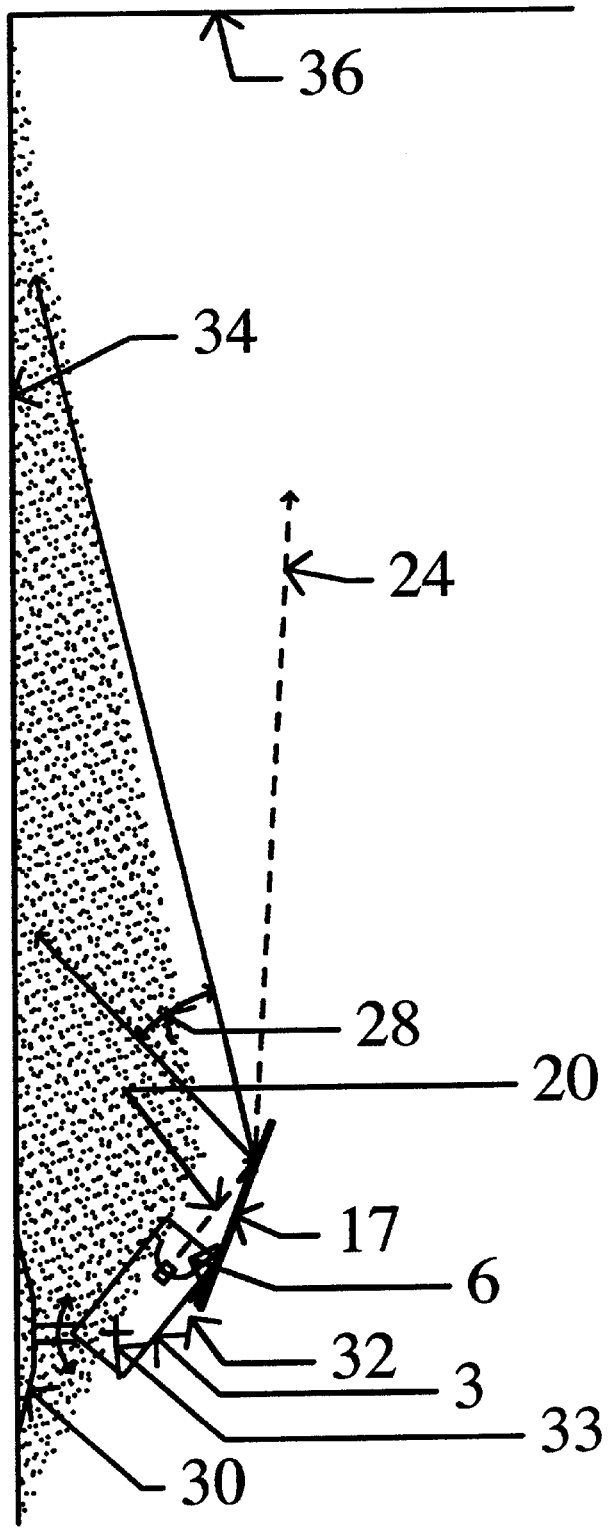
FIG. 11 is a diagrammatic section showing a wall-mounted fixture of the present invention using a tilted diffraction grating.

FIG. 11 shows a sectional view of the fixture mounted on a vertical wall surface 34 and the ceiling plane 36.

Figure 12:
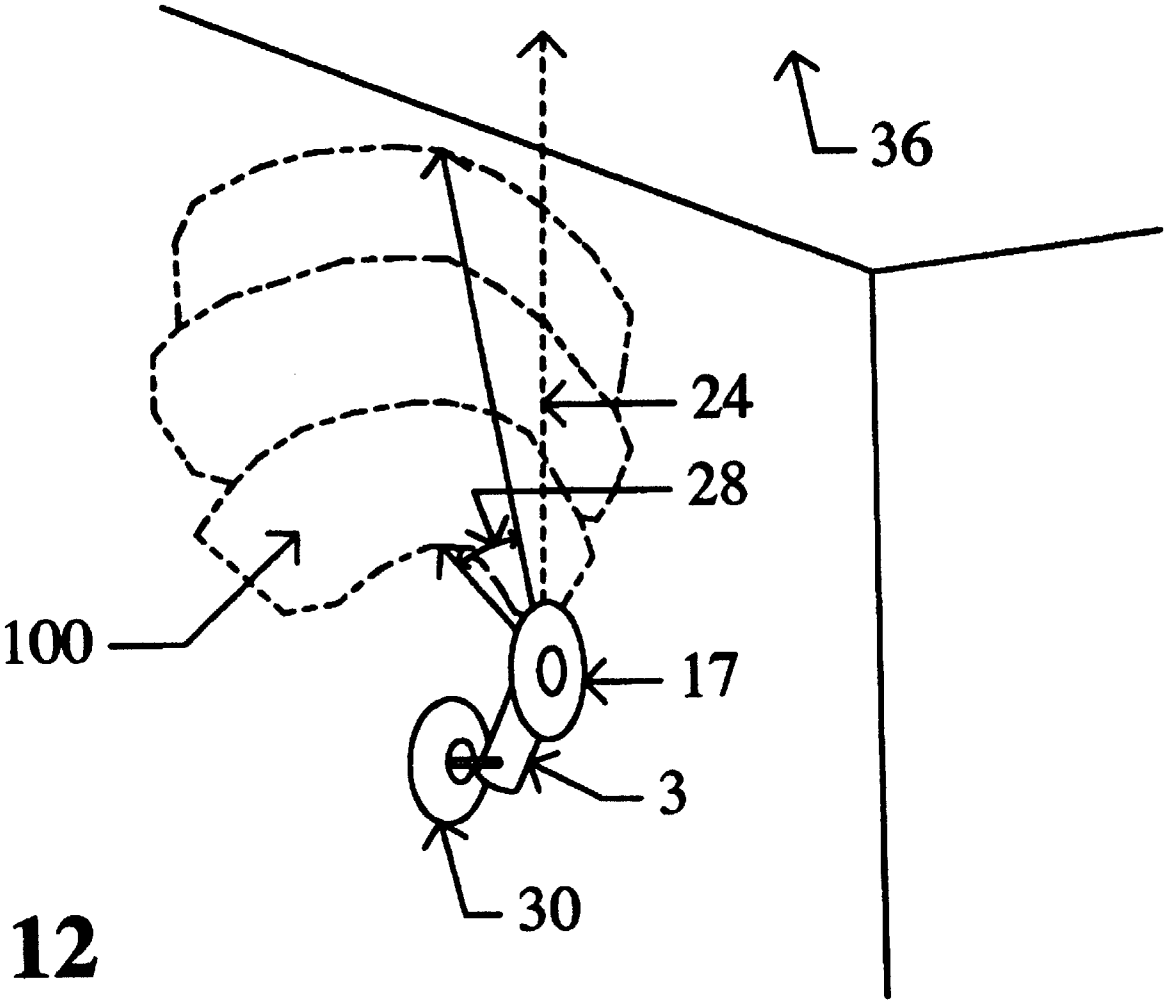
FIG. 12 is a perspective view of the fixture shown in FIG. 11.

FIG. 12 shows a perspective view of the fixture mounted on a vertical wall surface. This view shows the rainbow display 100 projected on the wall surface, and the white incident light 24 projected towards the ceiling 36.

Figure 13:
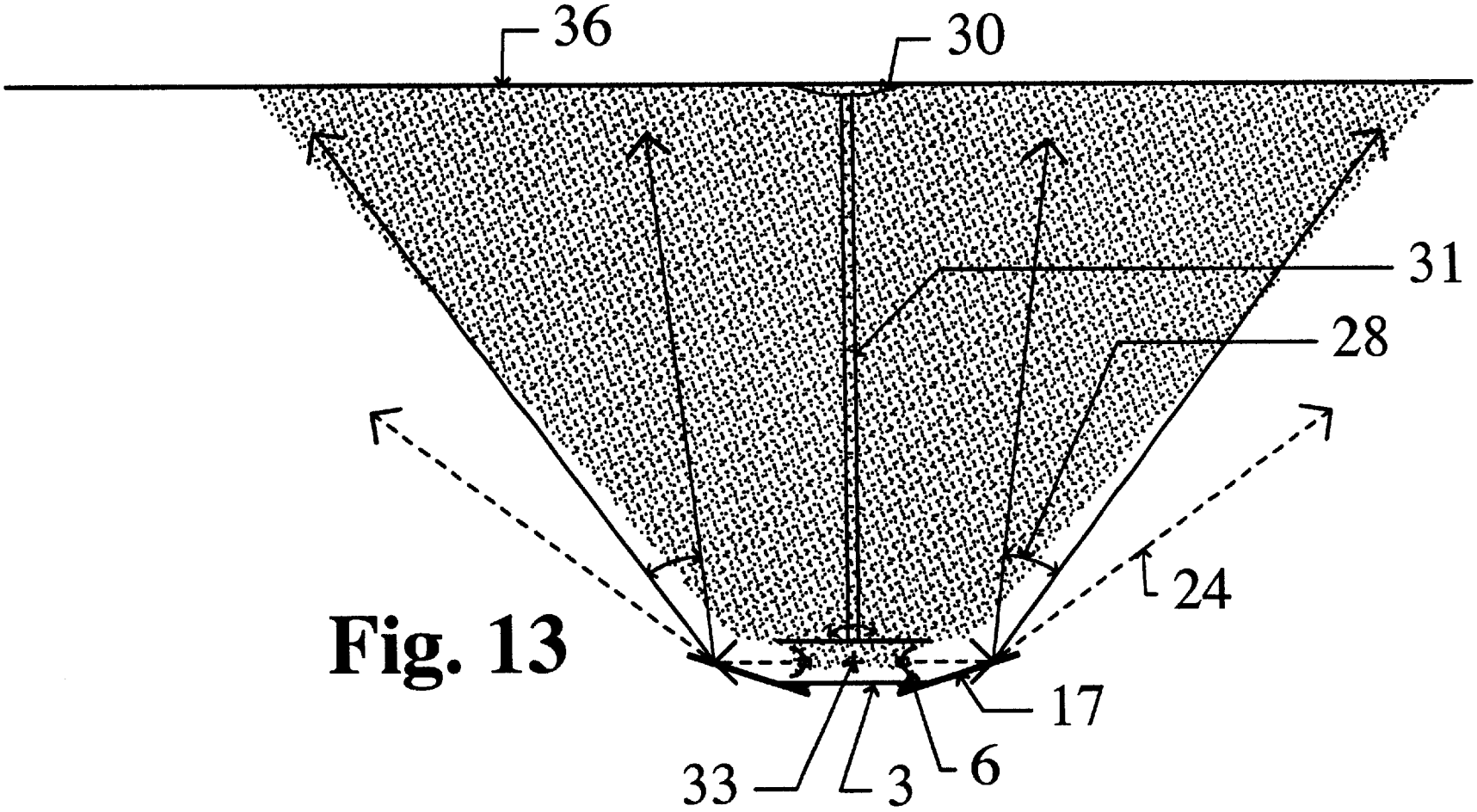
FIG. 13 is a diagrammatic section showing a ceiling-mounted fixture of the present invention using a tilted diffraction grating.

FIG. 13 shows a sectional view of the fixture mounted on the ceiling 36 with two similar light sources 6 with diffraction gratings 17 that are directly opposed to each other, so that they project two displays of rainbow light onto the ceiling 36. With an extended mounting arm 31, the fixture is mounted to the ceiling with basically the same base that has been used in previous versions, allowing the angle that the fixture is set to the ceiling to be adjusted to create asymmetrical light displays. A single version of this fixture may also be used.

Figure 14:
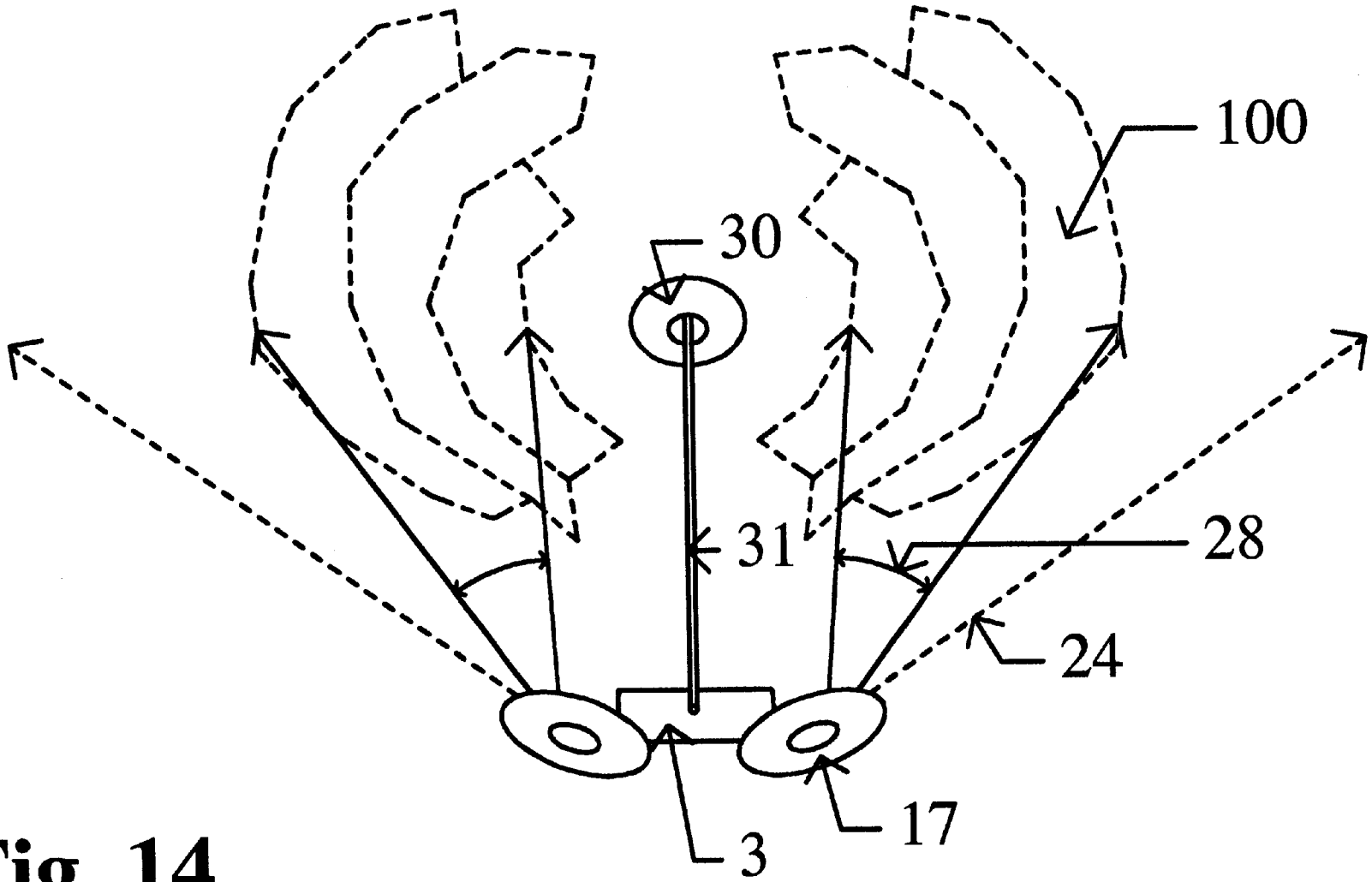
FIG. 14 is a perspective view of the fixture shown in FIG. 13.

FIG. 14 shows a perspective view of the ceiling-mounted fixture showing the rainbow display of light 100, and the white incident light 24, projected on the ceiling plane.

Figure 15:
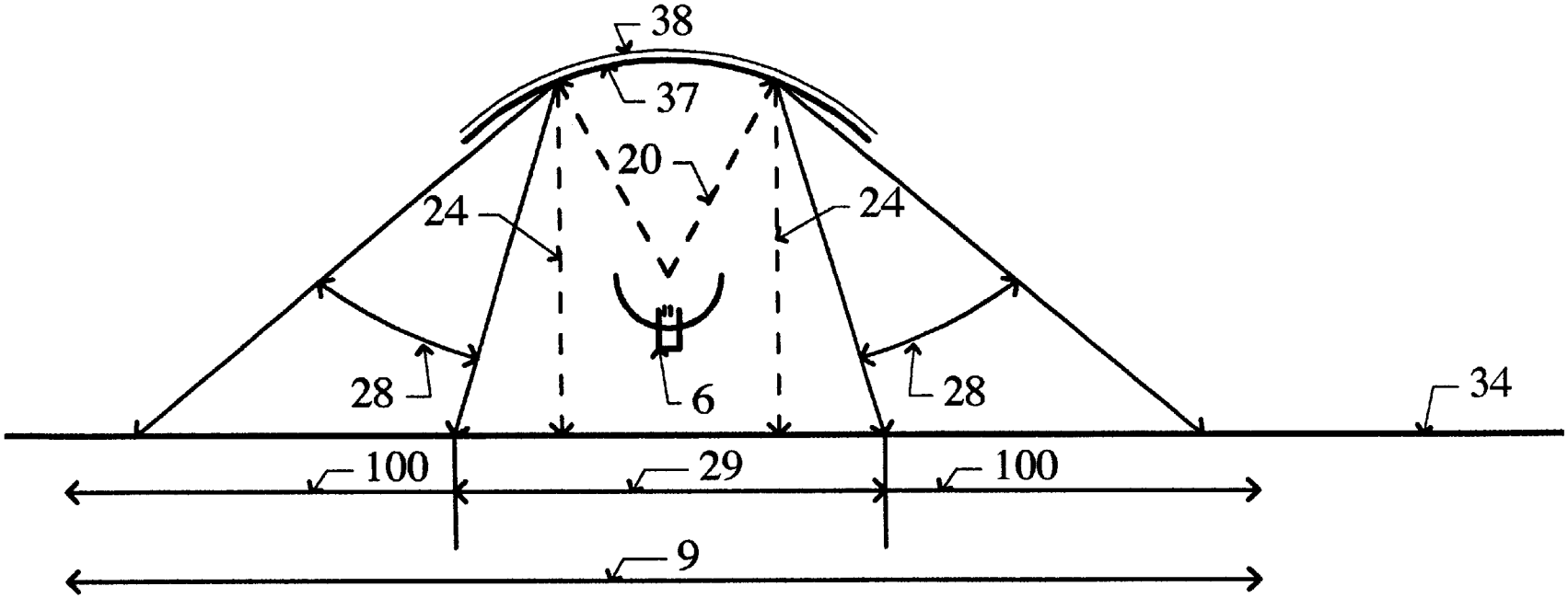
FIG. 15 is a diagrammatic section describing the principles behind the linear diffraction grating lighting system.
Figure 16:
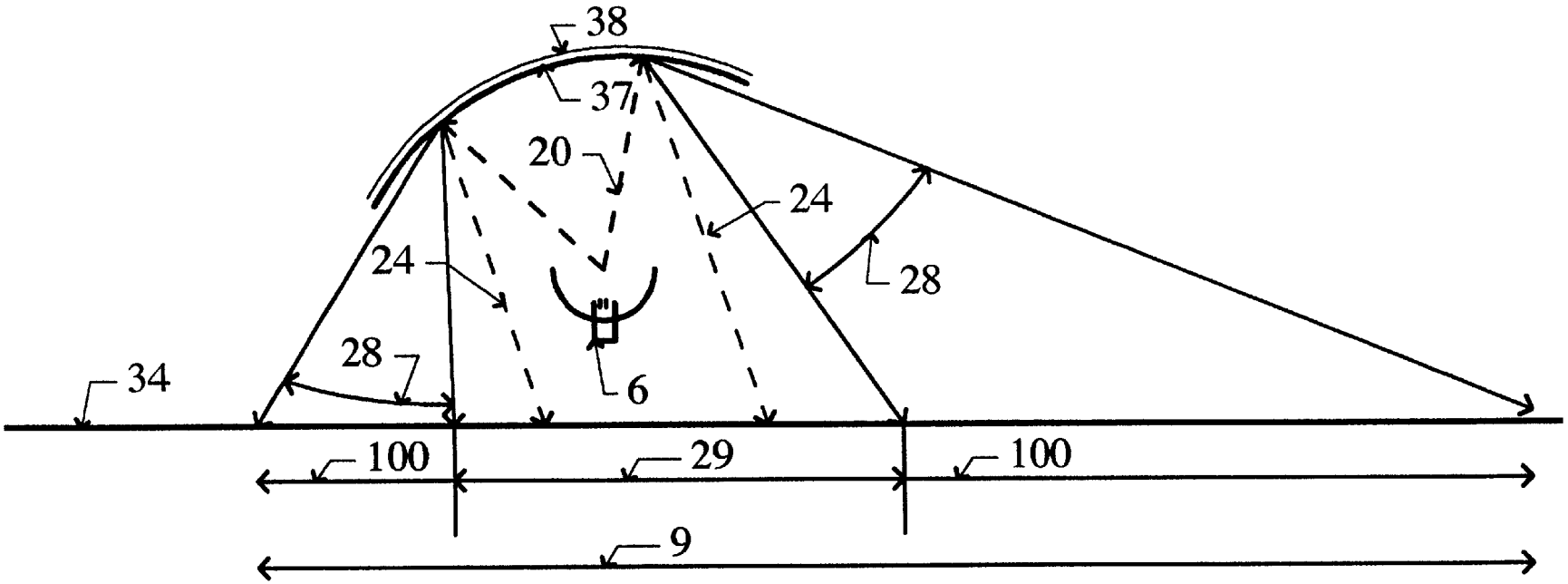
FIG. 16 is a diagrammatic section describing the principles behind the linear diffraction grating lighting system when tilted off-axis.
Figure 17:
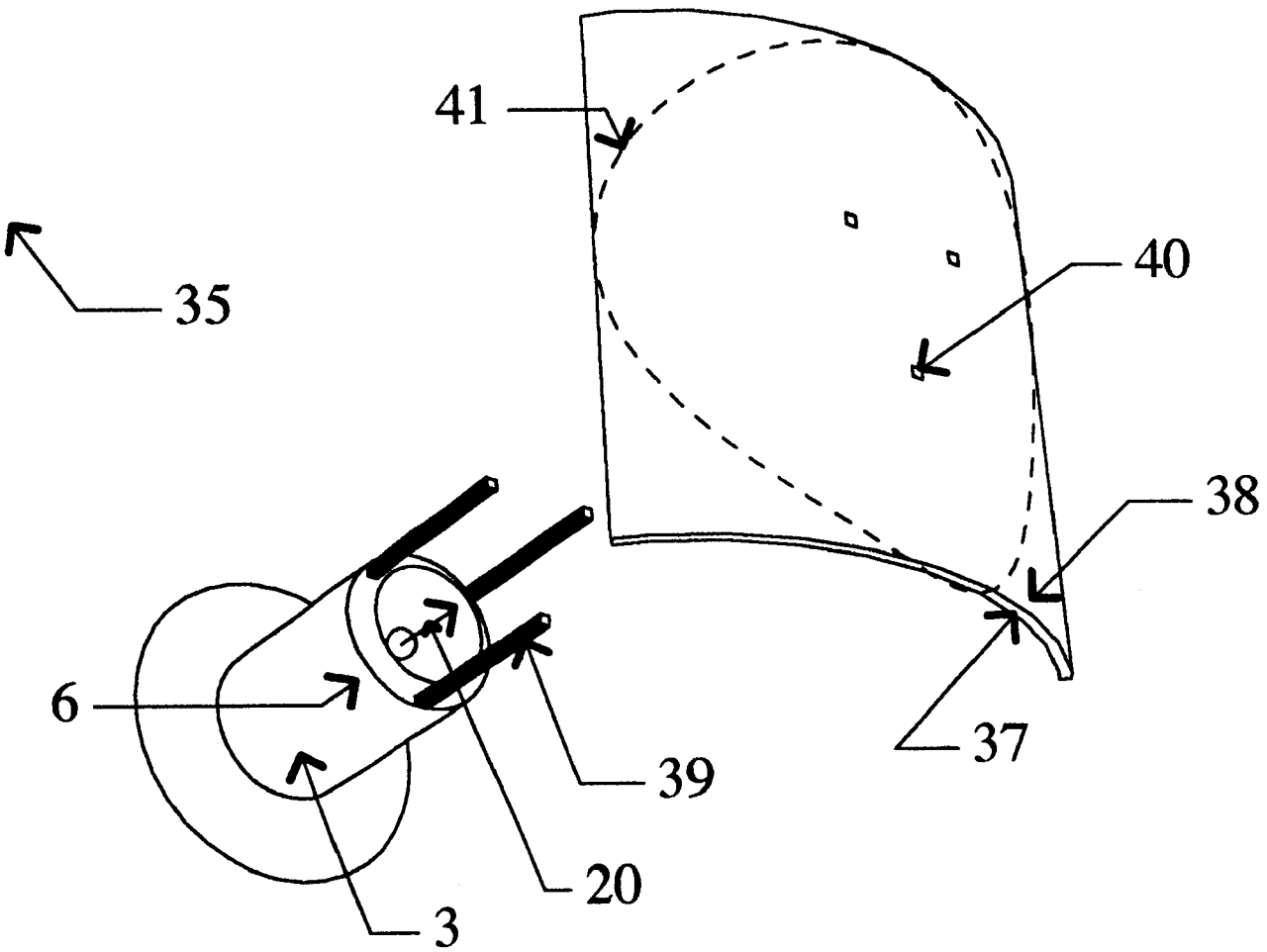
FIG. 17 is an exploded perspective view of the linear diffraction grating lighting system.
Figure 18:
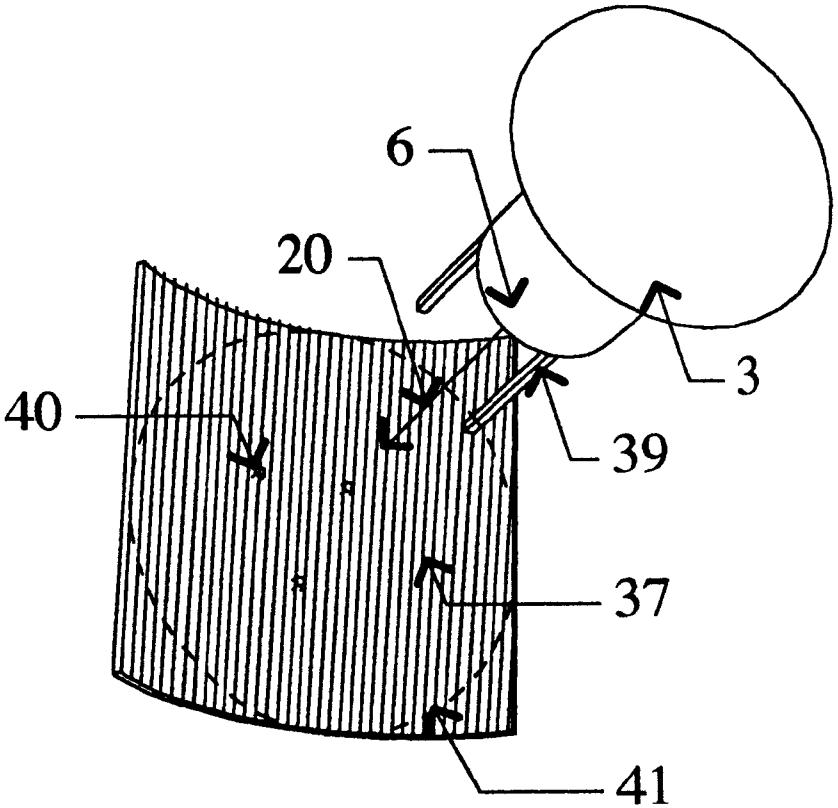
FIG. 18 is an exploded, reverse perspective view of the linear diffraction grating lighting system.
Figure 19:
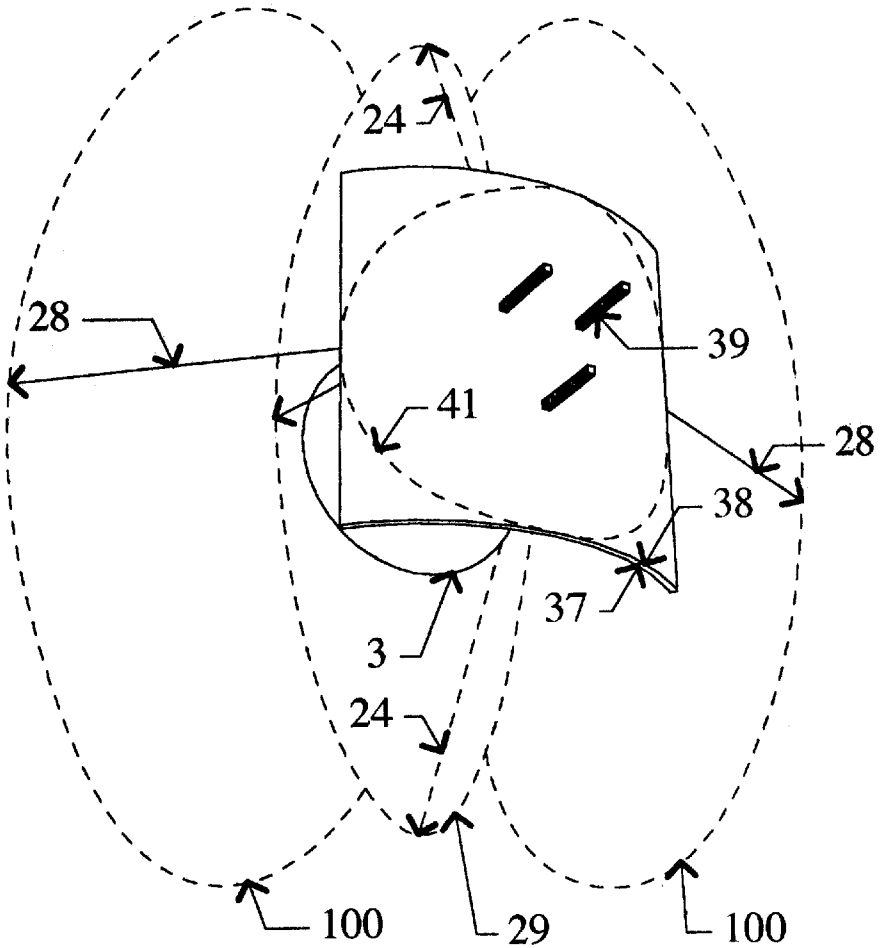
FIG. 19 is a perspective view of the linear diffraction grating lighting system.
Figure 20:
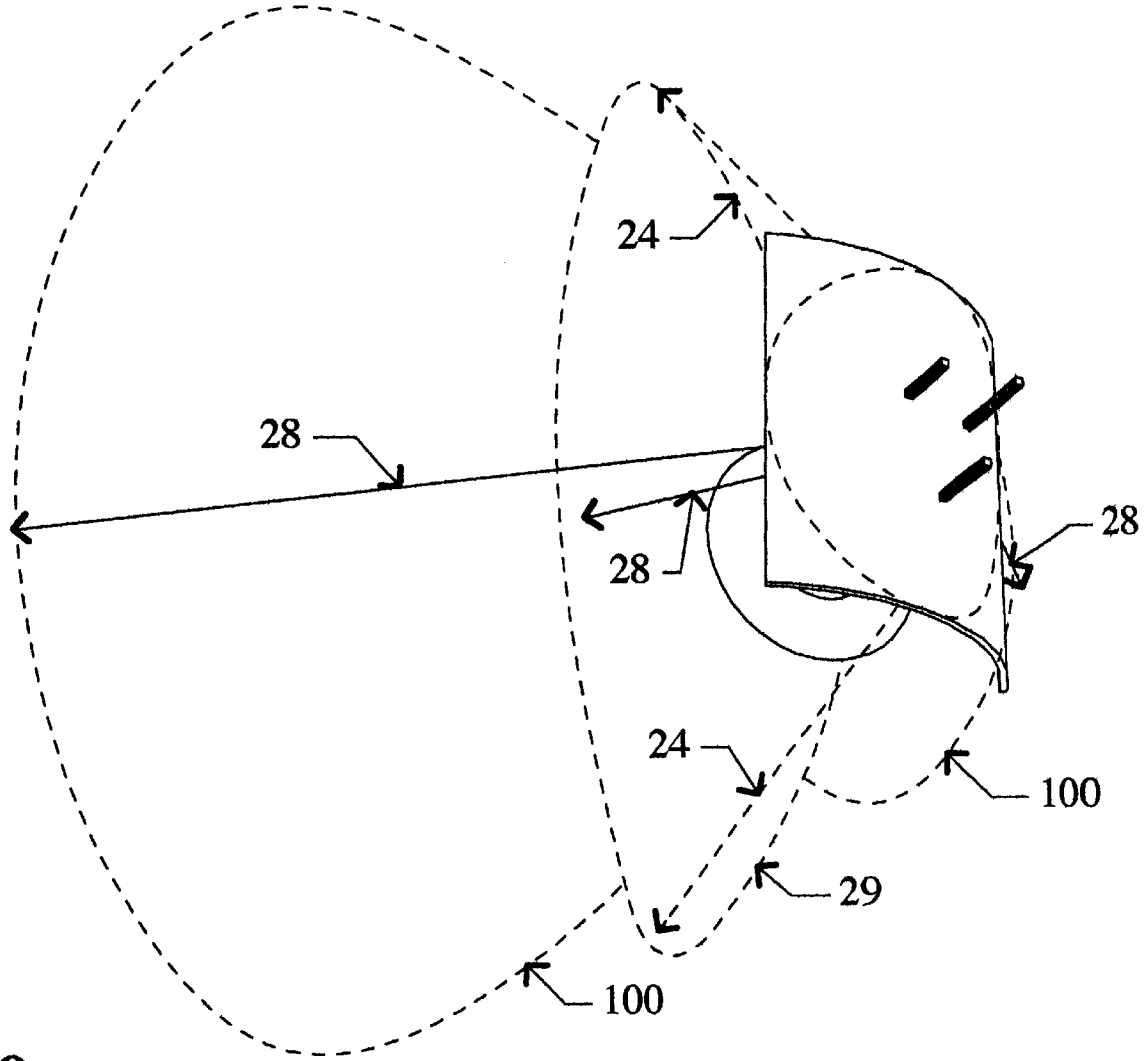
FIG. 20 is a perspective view of the linear diffraction grating lighting system showing the diffraction grating tilted off-axis to produce asymmetrical lighting effects.

FIG. 15 shows a sectional view of a configuration that uses a flexible, linear diffraction grating 37 mounted to a piece of sheet metal 38. The diffraction grating is made out of an adhesive backed holographic decal similar to the "rainbow tape" sold by Witchcraft Tape Productions. This particular tape is ideal for this application because it is basically a high resolution reflective diffraction grating that has no other pattern or color imbedded into its surface, as do so many other decorative holographic decals. Imbedded patterns create interference which weakens and often obscures the spectral display. Decals with a colored coating change the white light source 20, into the single color of the coating which cannot be defracted. The grating may be warped in any axis in relation to its grooves to produce a variety of effects, but for this example the grating has been warped in an axis parallel to its groove axis. This orientation produces the most vivid displays because the grooves remain straight and generally perpendicular to the light axis, whereas if the grating were warped perpendicular, the grooves would be generally parallel to the light axis, and basically ineffective. The resulting curvature of the grating causes the multi colored first spectral order 28, to be projected outside of the white "zeroth" order light 24. The resulting display concentrates the white light directly around the fixture 29 while projecting the first spectral order in a broad display to the outside 100. This arrangement works well for wall sconces and any other application where it is advantageous to keep the overall distance between the diffraction grating 37 and the projected surface 34 to a minimum and still maintain a broad display area of rainbow light 100. The display relies on a quartz halogen light source 6 that is best mounted in a housing 3 that directs the light in the same manner as the previous fixtures. Compact under-cabinet fixtures such as item # LS-120 made by Lite Source, Chino, Calif. 91710 provide an ideal light source because their compact profile allows the fixture to project a minimal distance from the wall surface. The 20 watt quartz halogen light source also works quite well. This configuration works best as a wall sconce because it makes the pleasing light patterns most visible to the observer, especially when mounted at eye level. The diffraction grating assembly 37, 38 may be tilted off-axis to the light housing 3, as shown in FIG. 16, to create an infinite variety of lighting patterns on the projected surface depending on the orientation and degree of its tilted angle. FIG. 17 is an exploded view showing the sandwiched diffraction grating 37 and sheet metal 38 removed and suspended in front of the rest of the fixture for descriptive clarity. The light housing 3 can be attached directly to a vertical wall surface 34. Inside of the housing is the light source 6 which is a spot source aimed outward towards the diffraction grating assembly 37, 38. Mounted to the perimeter of the light housing are 3 small diameter rods 39. At the center of the diffraction grating assembly are three holes 40 that correspond to the same dimensional spacing as the rods, but with slightly larger diameters, so that rubber grommets can be placed inside of the holes. The rods are placed through the holes in the rubber grommets so that the friction created between the grommets and the rods hold the grating assembly at whatever angle is chosen. The friction is sufficient to hold the grating assembly in place without the use of any other fastening means. The rods preferably protrude far enough from the light housing to allow a wide range of adjustments to be made to the angle and position of the grating in relation to the housing. FIG. 18 is a reverse view showing the grooves of the grating 37 in relation to the overall assembly. FIG. 19 shows the complete fixture and the resulting light patterns that are projected on the wall surface 34. With this particular arrangement, the first order "rainbow" light is projected to the far sides 100 with the "zeroth order" white light projected at the center 29. FIG. 20 shows what happens when the grating assembly 37, 38 is positioned at an angle that is off center from that of the light housing 3. A pleasing asymmetrical display is created. Many other variations may be created such as:

1. Making the grating surface either flat or convex, instead of concave. Both of these create a more diffuse display with less color intensity.
2. Changing the perimeter shape of the grating assembly from square to round, to an infinite variety of shapes and profiles. FIGS. 17–20 show a round shape 41 dotted in for clarity which also corresponds to where the beam of light 20 hits the surface of the diffraction grating 37. Whatever shape is chosen, its perimeter should not fall within this circle, or light directly projected from the source 20 will miss the surface of the diffraction grating and cause glare to the observer.
3. Hammering the surface of the grating assembly to produce a softer more doppled lighting display.
4. Adjusting the distance of the grating assembly from the light source to change both the size and intensity of the display.

5. Adjusting the type of light source to change the clarity of the display.
6. Adjusting the resolution of the diffraction grating to change the clarity and intensity of the display.
7. Changing the orientation of the diffraction grating in relation to the curved surface to soften and create asymmetrical displays.
8. Combining several diffraction gratings of various resolutions and orientations to create special displays.

Figure 21:
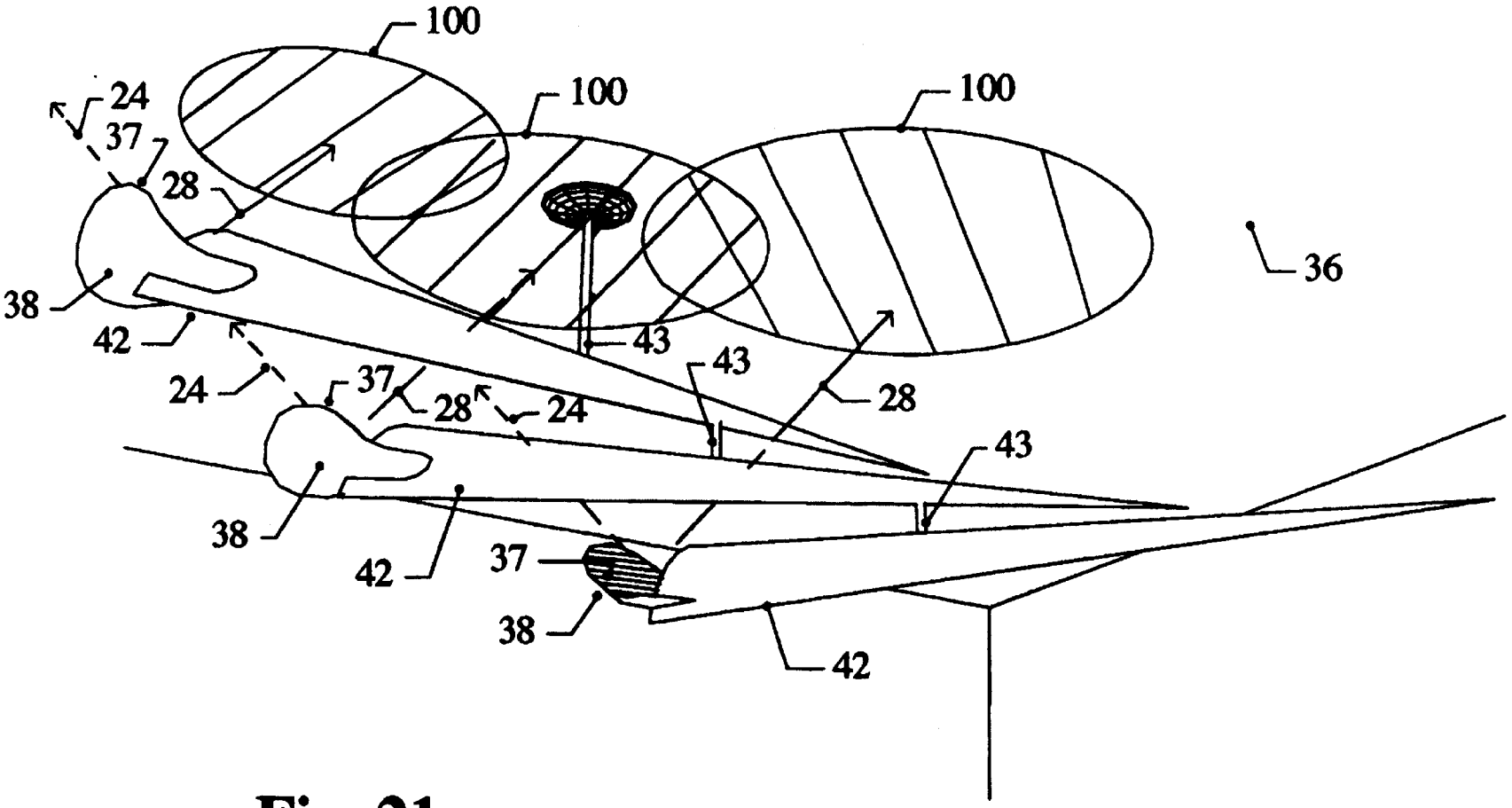
FIGS. 21–24 show a combination of spectral lighting components and a mobile lighting system.
Figure 22:
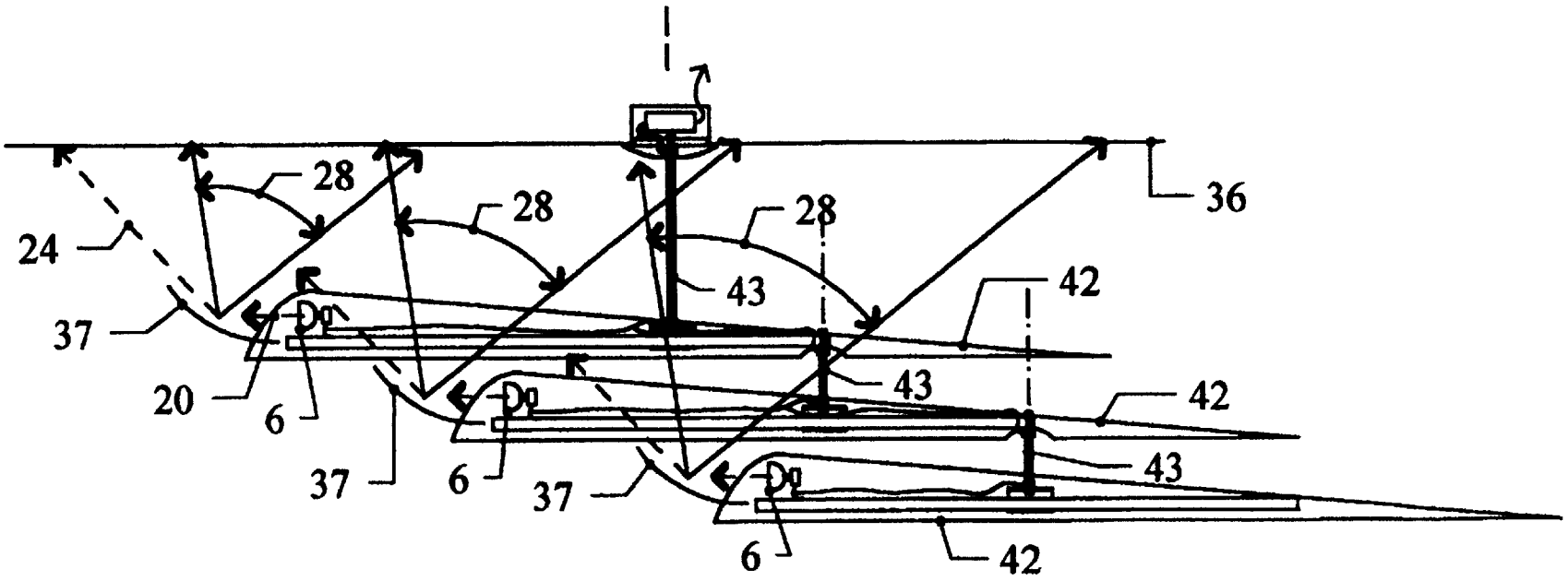
Figure 23:
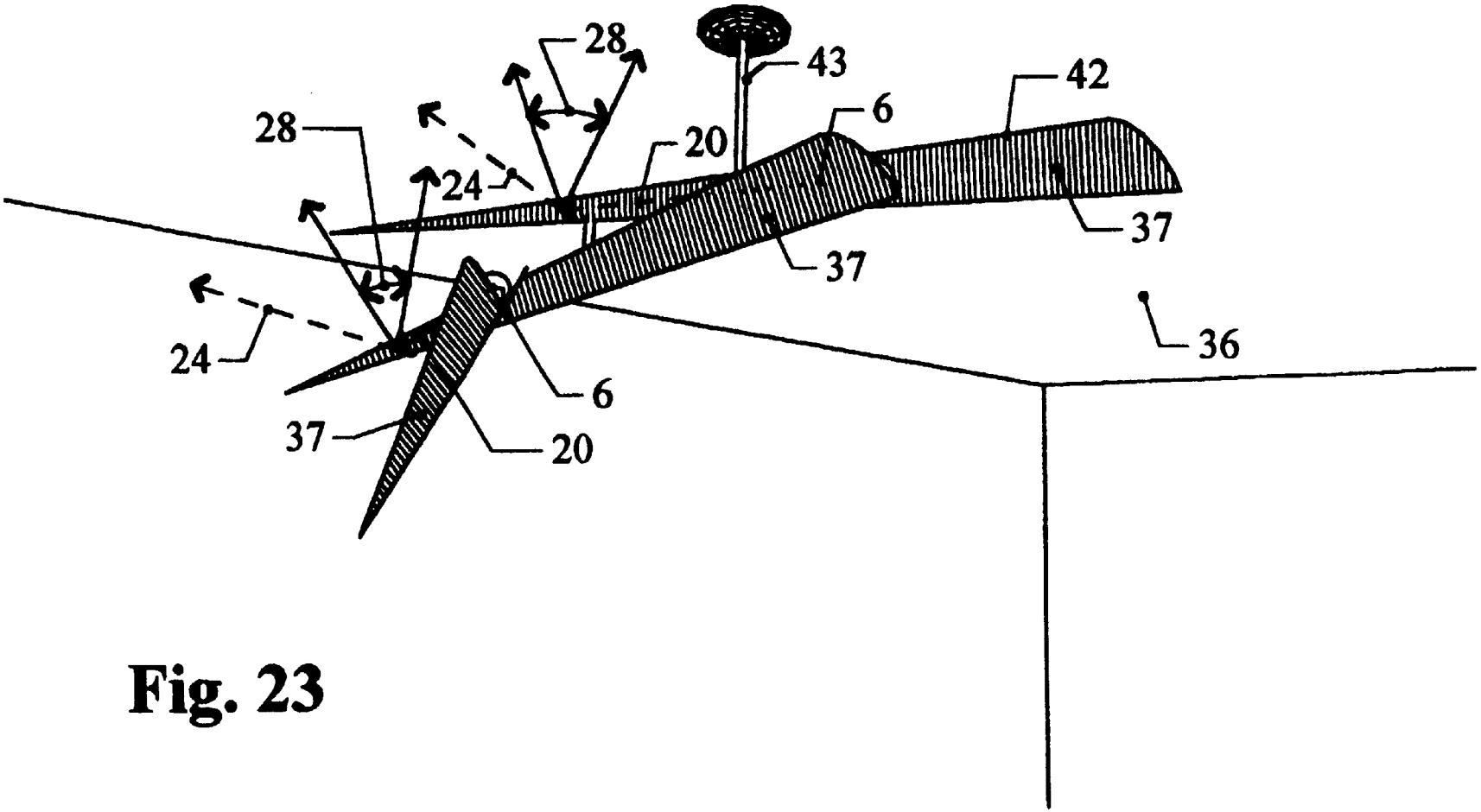
Figure 24:
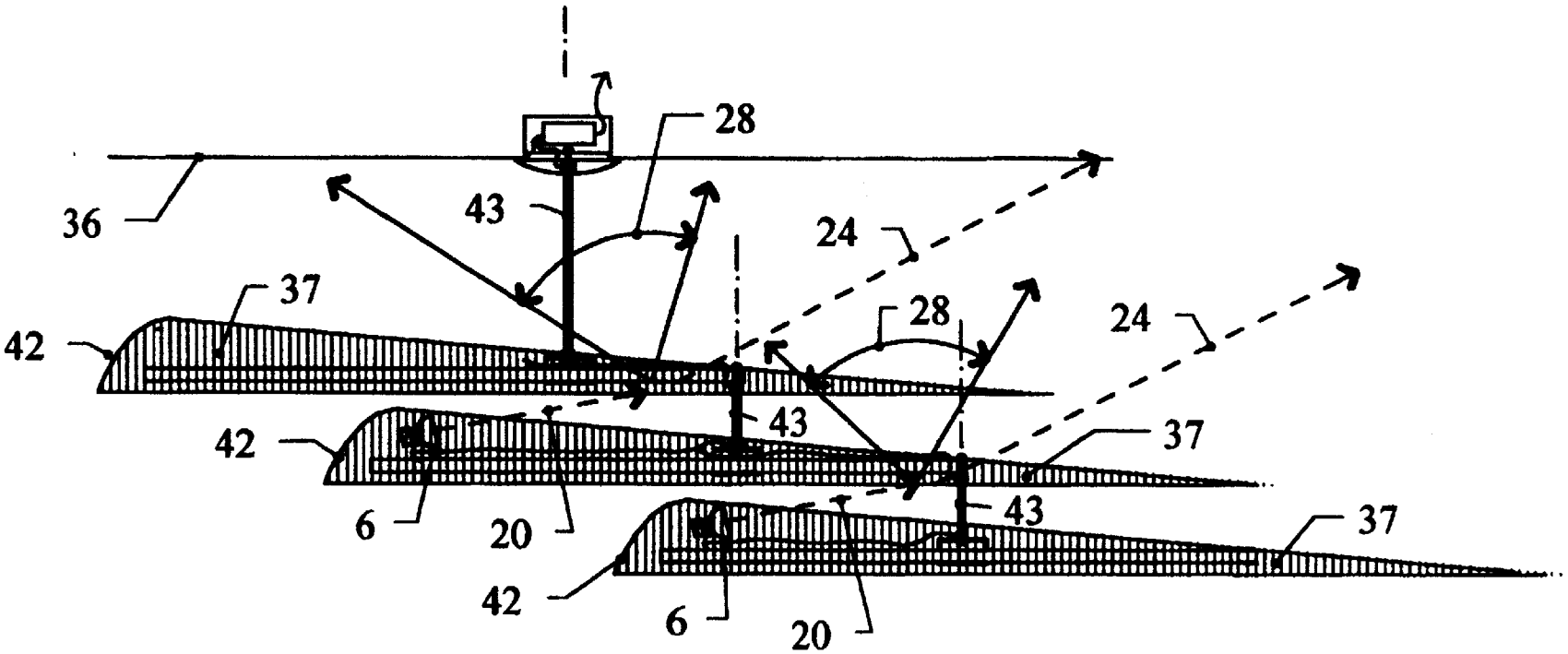

FIGS. 21–24 show a combination of spectral lighting components and a mobile lighting system. A description of parts of the mobile lighting system not discussed herein can be found in my earlier U.S. patent application Ser. No. 08/735,069, which will issue on Aug. 11, 1998 as U.S. Pat. No. 5,791,775. FIGS. 21 and 22 show a three appendage mobile light with a diffraction grating film 37, mounted to a piece of sheet metal 38, (mounted in the same fashion, with the same materials described in FIGS. 15–20) and attached to the ends of each of the appendages 42. A concealed light source 6 (FIG. 22) is housed in each appendage and aimed at the diffraction grating surface so that a combination of multi-colored spectral light 28, and white light 24, are projected onto the ceiling 36. As the appendages orbit about each other at their swivel points 43, the spectral displays projected on the ceiling 100, move about and mix with each other creating an ever-changing display of light and color. The displays are similar to what could happen if you could animate a painting by Kandinsky. FIGS. 23 and 24 show a three appendage mobile light with a diffraction grating film 37, coating the surface of each appendage 42. Each appendage houses a concealed light source 6 that is aimed where the swivel point meets the appendage directly above it. Each light source is in constant contact with the diffraction grating film covering the body of the adjacent appendage. As the appendages rotate about their swivel points the incident angle of the diffraction grating to the light source changes resulting in a wide variety of both the intensity and direction of the spectral display. With this configuration, the displays could vary from completely white light to totally colored light projected onto every surface of the room. At times the body of each appendage 42, could either appear to be ablaze with either colored or white light when the incident angle aligns with the sight angle of the observer, and the diffraction grating coating its surface 37, directs light directly towards the observer. In either embodiment of the mobile, spectral light, the shape and total number of appendages is variable. In the second embodiment, it is not necessary to have a light source in the top appendage since there is no other appendage for it to shine upon.

Figure 25:
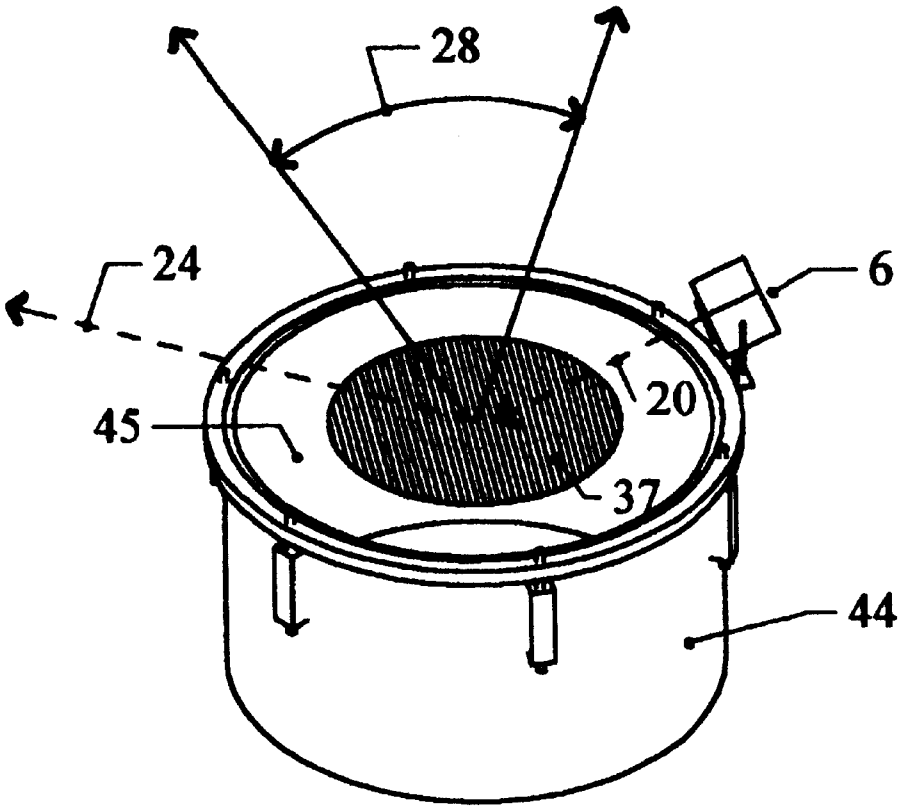
FIGS. 25 and 26 show how a spectral lighting apparatus can be mounted onto a drum to produce spectral displays that are animated as the drum is played.
Figure 26:
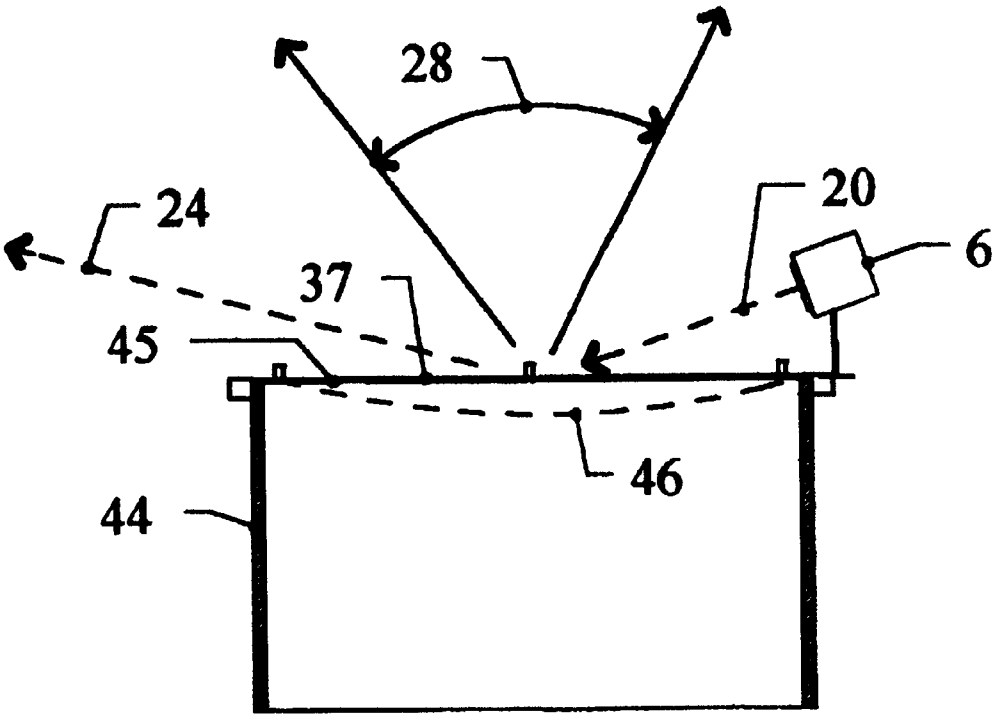

FIGS. 25 and 26 show how a spectral lighting apparatus can be mounted onto a drum to produce spectral displays that are animated as the drum is played. The lighting apparatus consists of a light source enclosed in an adjustable housing 6, that is mounted to the rim of the drum 44, and a diffraction grating film 37, that is applied to the center of the drumhead 45. Depending on the angle that the drum is set up in relation to surface that the spectral display will be visible to the audience, the angle and orientation of the light source 6, can be adjusted in relation to the diffraction grating 37, on the drumhead 45, by either tilting or raising the light source. As the drum is played, the incident angle is changed as each beat deflects the drumhead and the diffraction grating attached to it 46, resulting in a pulsating display of spectral light 28. Hot spots of color can be achieved with repeated beats to a particular area on the drumhead. The entire apparatus may be flipped to the underside of the drumhead if it is more desirable to project light out of the bottom of the drum. If the drumhead is clear, a transmissive grating could be used by placing the light source at the opposite side of the drumhead from where the displays will project from.

Figure 27:
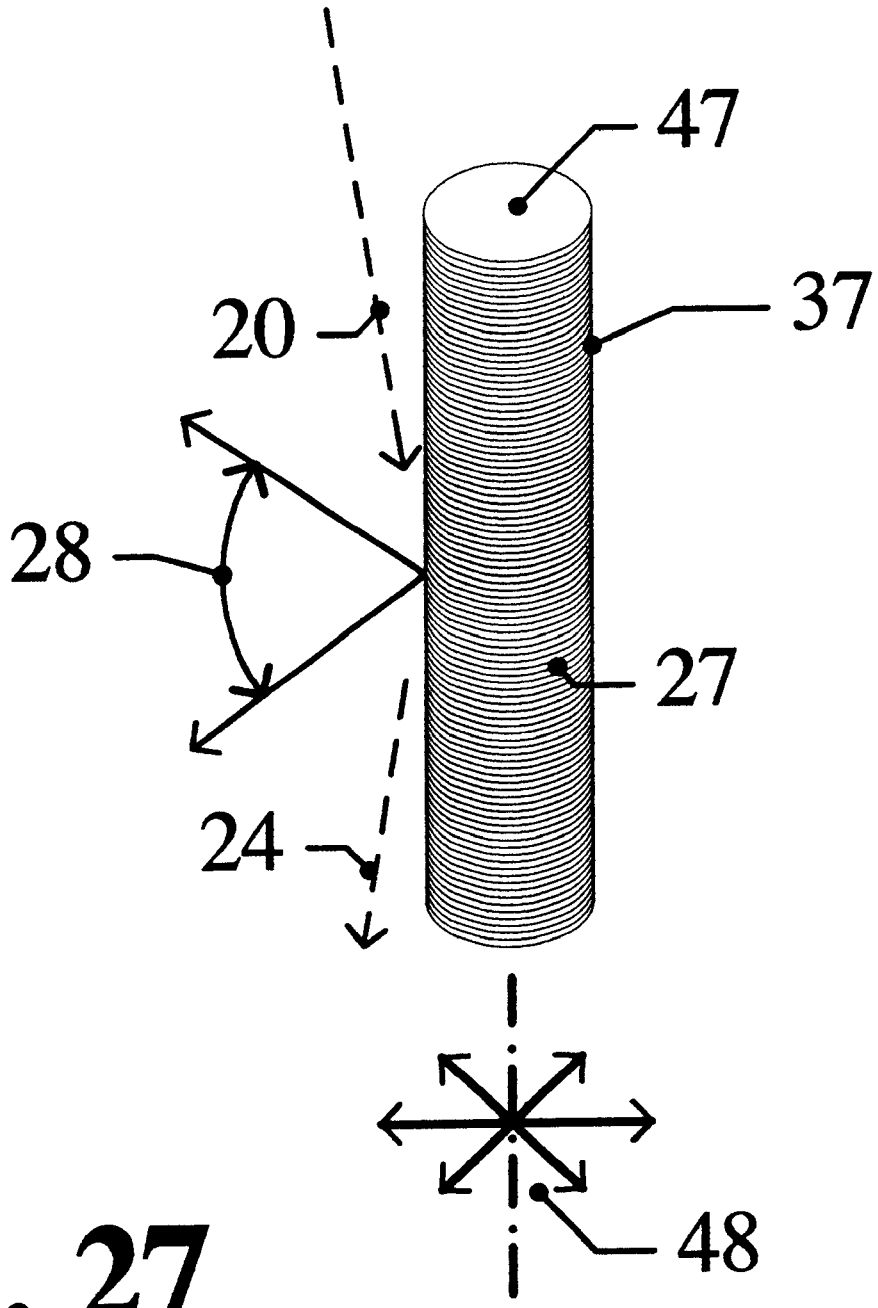
FIG. 27 shows a diffraction surface of the present invention which is formed by rolling diffraction film into a tube.

In the mobile, spectral light as described in FIGS. 23, 24, it was found that exposing the surface of the diffraction grating directly to the eyes of the observer created some desirable effects. FIGS. 28–33 show lighting apparatuses that project colored light directly to the observer as well as onto an adjacent surface. All of these apparatus share a similar method of configuring the diffraction surface which is shown in FIG. 27. By wrapping the surface of a tube 47, with a reflective, diffraction grating film 37, (as described in FIGS. 15–20), so that the microscopic grooves of the grating 27, align in a radial pattern along the length of the tube, (so that they are oriented perpendicular to the length of the tube), creates intense colored light to emanate along the central portion of the tube. The resulting effect is that of a highly charged neon tube with a steady gradation of color along its length. The spectral display 28, is visible from many view angles because the radial pattern of the grooves 27 creates an infinite number of correct angles 48, for optimal viewing of the spectral display. An alternative to this configuration could be to wrap a transmissive diffraction grating around a piece of neon or fiber optic tubing to produce colored displays when viewed from an oblique angle.

Figure 28:
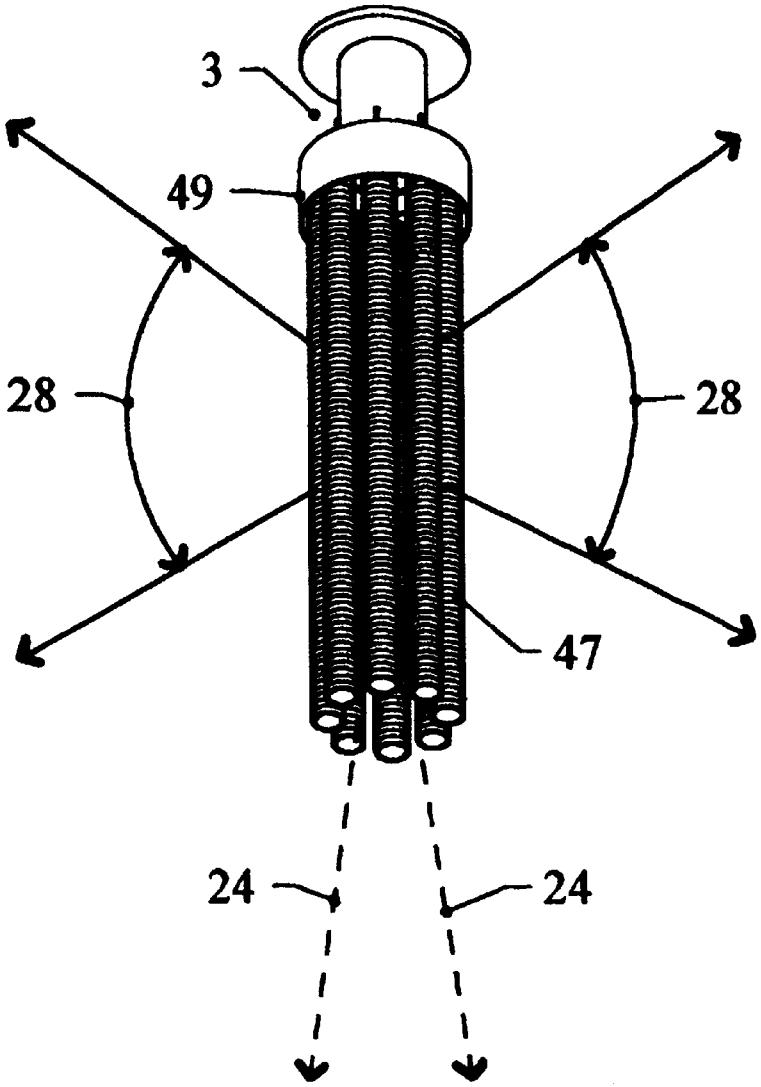
FIGS. 28–33 show lighting apparatuses that project colored light directly to the observer as well as onto an adjacent surface.
Figure 29:
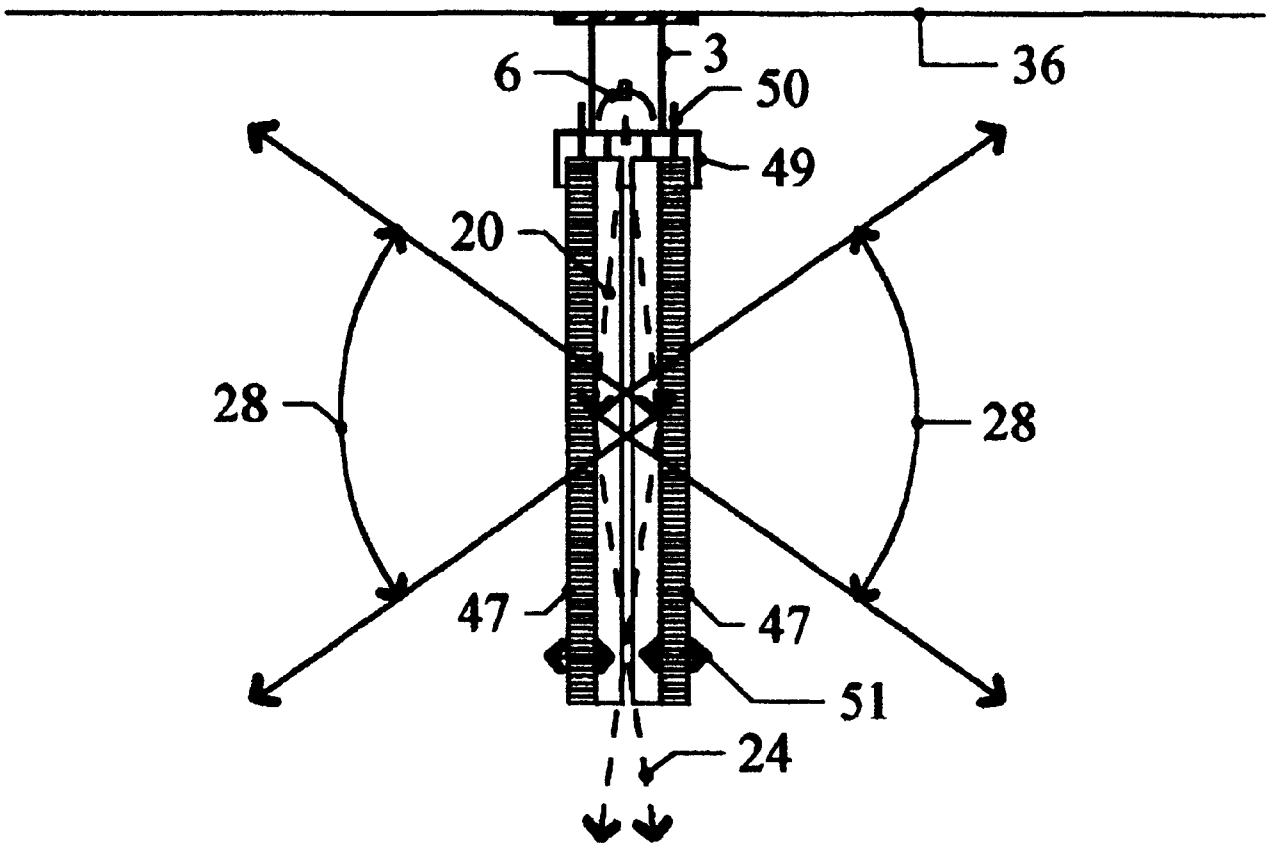
Figure 30:
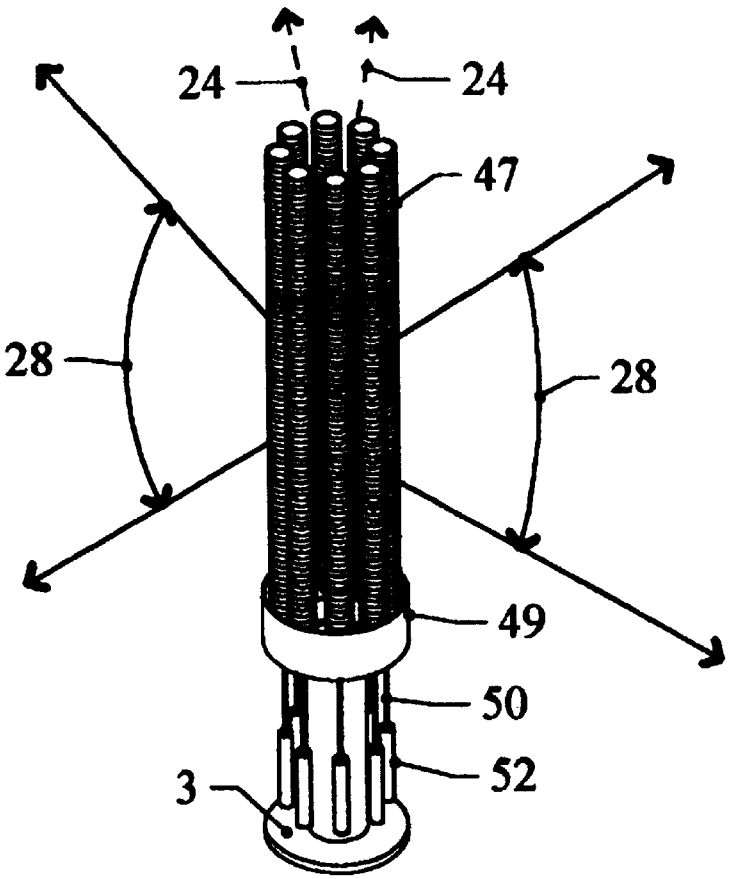
Figure 31:
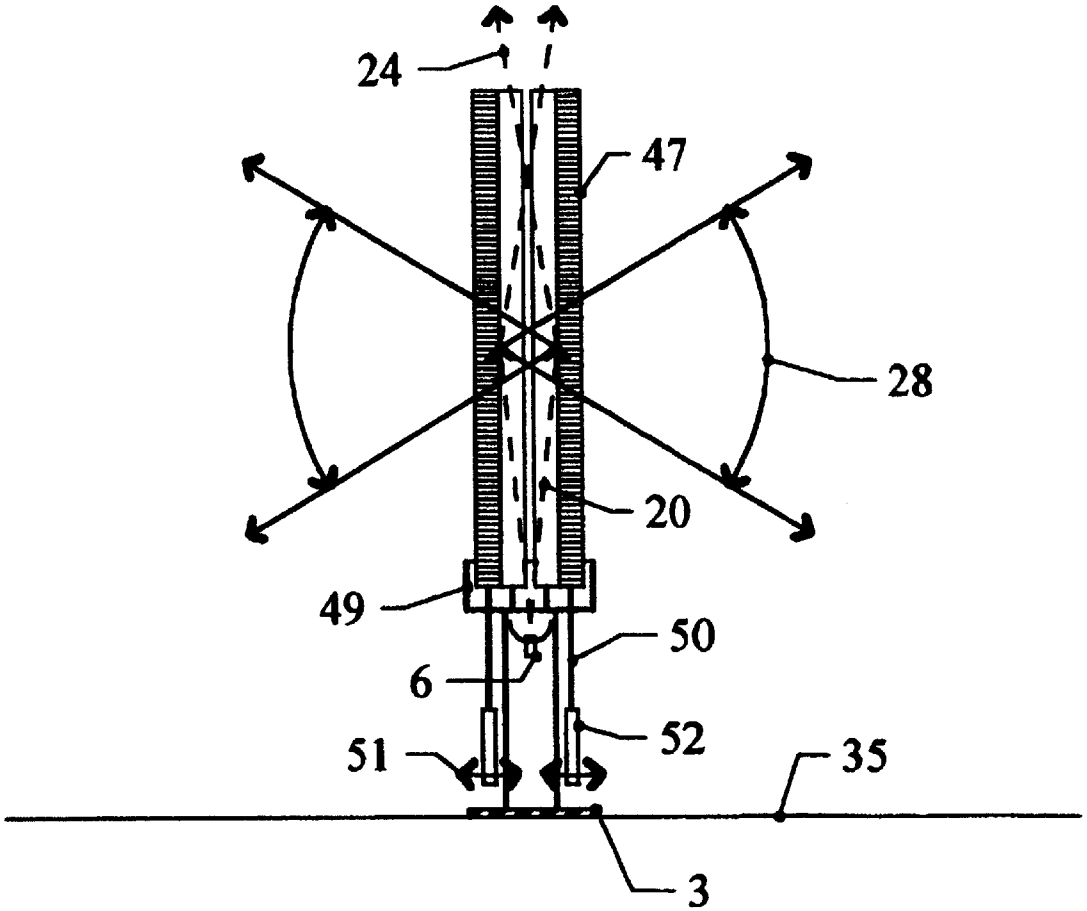
Figure 32:
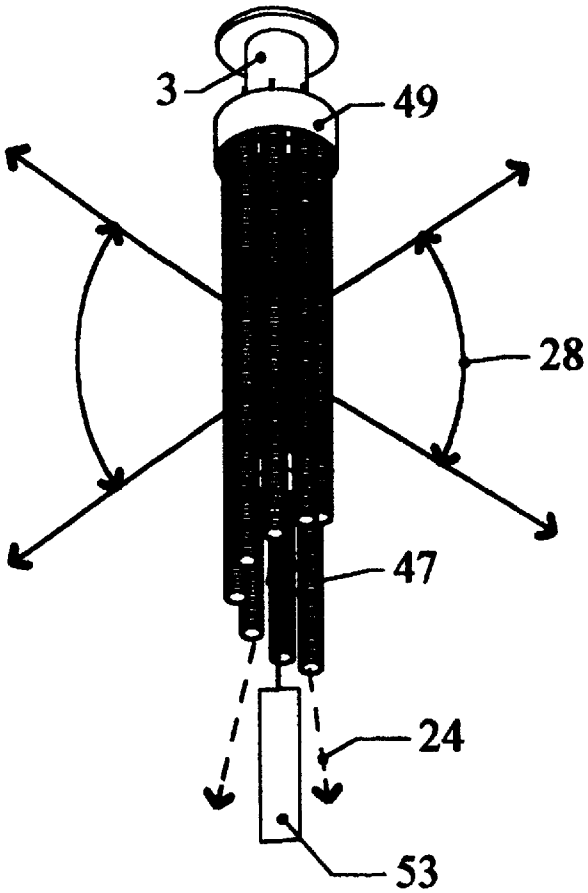

FIGS. 28 and 29 show a ceiling-mounted light fixture that incorporates a series of tubular diffraction gratings 47, arranged in a radial fashion around a light source 6. The tubular diffraction gratings are spaced a distance apart so that the most intense spectral displays 28, are visible from within the center of the fixture. The light source 6, is placed at the top end of the tubes 47, and aimed downward so that the white incident light 20, hits the tubes in an appropriate angle to produce a display of colored light 28, from opposing sides of the fixture. White light 24, is projected downward in a similar manner as a recessed spot light. The light housing 3, attached to the ceiling 36, incorporates a baffle 49, which hides the light source 6, and provides a point of anchorage 50, for the tubes 47. The tubes may be mounted in either fixed or allowed to pivot 51, with the passing wind which will also produce a more varied spectral display. FIGS. 30 and 31 show a similar version of the previous fixture that is designed to be placed on the floor or a table 35. The basic components are identical to the previous fixture with the addition of counterweights 52, attached to the base of each tube 47, allowing them to sway 51, in an upright position. FIG. 32 shows a ceiling-mounted version of the previous fixture that incorporates a wind chime element. In this fixture, the tubes 47, are made of a material that will produce a pleasing sound when struck with a wind driven clapper 53, hung in the center of the fixture. The tubes are at graduated lengths to produce various notes when struck.

Figure 33:
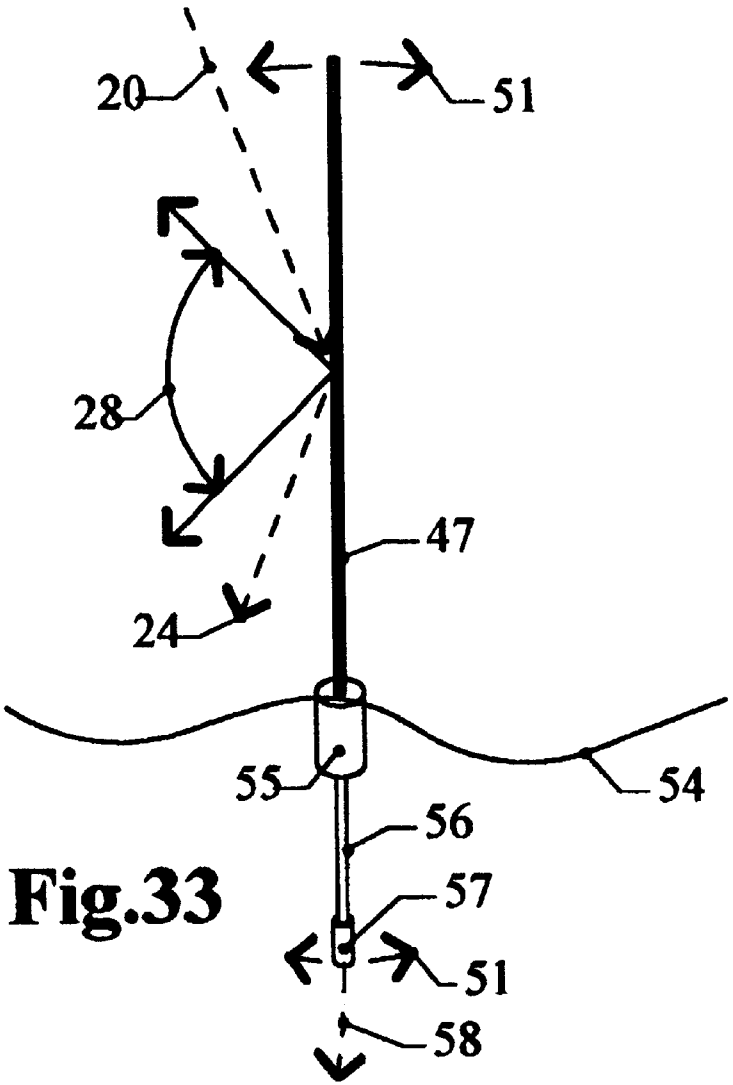

Sunlight can also be used as a light source to generate colored displays from the diffraction tubes. In many ways it is the ideal light source because its size and distance produce a very broad and powerful spectral display with great variety from dawn to dusk. Long lengths of tubing can appear to be energized with a single color and change color even in a fixed position as the attitude of the sun cycles through the day. Whereas the light from a neon tube is not readily visible in direct sunlight, the light from a diffraction tube, being powered by the sun, is highly visible. Exterior applications for diffraction tubing can range from the decorative, as in a single length placed in the garden, to the informational, as used in the same manner as neon bent in the shapes of letters and figures for signage, to the practical, as used in highly visible ways of marking things for navigation, industry and safety. FIG. 33 shows a diffraction tube 47, used as an ocean going marker buoy. The tube 47, is mounted to a float 55, with a tubular keel 56. At the end of the keel is a counterweight 57, with a point of attachment for an anchor line 58. The float and keel are configured to keep the buoy upright while still allowing it to rock back and forth 51, in the ocean waves 54. The more that the buoy is allowed to rock the greater the range of colored light 28, visible at a distance. The rocking causes this because the white sunlight 20, remains at a relatively fixed angle while the surface of the diffraction grating 47 rocks back and forth causing the resulting angles of white 24, and colored light 28, to appear to rock with it and increase the range from which it is visible.

Holographic tape, which can be used as a diffraction grating in the apparatus shown, for example, in FIGS. 15–33, can be purchased from Witchcraft Tape Productions.

All examples herein use reflective diffraction gratings, but it is believed that one could also use transmissive diffraction gratings to produce attractive lighting effects.

The present invention works best with focused light beams or high intensity light beams. It appears that focused light works better than unfocused light, and perhaps collimated light is ideal. The light source for the preferred embodiments of the present invention using reflective diffraction gratings which seems to work best is a MR11 or MR16 low voltage spot light. Fluorescent lights and standard incandescent light bulbs do not seem to work as well, probably because the light is not well focused. Sunlight works well also as a light source for the reflective buoy.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

What is claimed is:

1. A lighting system comprising:

a light source having light beams emanating therefrom;

a diffraction means for diffracting some of the light from the light source into colored light, the diffraction means having a plane;

directing means for directing some of the colored light onto a ceiling or a wall; and means for varying the angle between the plane of the diffraction means and the light beams emanating from the light source.

2. The lighting system of claim 1, wherein:

the diffraction means comprises a CD or a laser disk.

3. The lighting system of claim 1, further comprising means for varying the distance between the diffraction means and the light source.

4. The lighting system of claim 1, wherein the directing means includes mounting means for mounting the light source on a wall, ceiling, or table.

5. The lighting system of claim 1, further comprising means for placing the diffraction means at an acute enough angle to the light source so that white light produced by the light source and the diffraction means can be substantially completely separated from the colored light produced by the light source and the diffraction means.

6. The lighting system of claim 1, further comprising a reflector on which the diffraction means is mounted and means for curving the surface of the reflector to focus and intensify the display of colored light produced by the light source and the diffraction means.

7. The lighting system of claim 1, further comprising means of attachment to a mobile lighting apparatus to animate the display of rainbow light produced by the light source and the diffraction means.

8. The lighting system of claim 1, wherein:

the diffraction means is transmissive.

9. The lighting system of claim 1, wherein:

the diffraction means is reflective.

10. The lighting system of claim 1, wherein:

the light source comprises an MR11 or an MR16 low voltage spot light.

11. The lighting system of claim 1, wherein:

the diffraction means is attached to the light source.

12. The lighting system of claim 1, wherein:

wherein the directing means includes mounting means for mounting the light source on a wall.

13. The lighting system of claim 12, further comprising the wall.

14. The lighting system of claim 1, wherein:

wherein the directing means includes mounting means for mounting the light source on a ceiling.

15. The lighting system of claim 14, further comprising the ceiling.

16. A lighting system comprising:

a light source;

diffraction means for diffracting some of the light from the light source; and a head of a drum or similar membrane that can be flexed upon impact to curve the surface of the diffraction means, the diffraction means being mounted on the head of a drum or similar membrane that can be flexed upon impact.

17. The lighting system of claim 16, wherein:

the diffraction means includes a diffraction grating.

18. A lighting system comprising:

a light source;

a diffraction means for diffracting some of the light from the light source into colored light;

directing means for directing some of the colored light onto a ceiling or a wall; and a reflector on which the diffraction means is mounted and means for curving the surface of the reflector to focus and intensify the display of colored light produced by the light source and the diffraction means.

* * * * *